US011578905B2

(12) United States Patent
Knatt et al.

(10) Patent No.: US 11,578,905 B2
(45) Date of Patent: Feb. 14, 2023

(54) ICE MAKER, ICE DISPENSING ASSEMBLY, AND METHOD OF DEPLOYING ICE MAKER

(71) Applicant: True Manufacturing Co., Inc., O'Fallon, MO (US)

(72) Inventors: Kevin Knatt, St. Louis, MO (US); John Friend, St. Louis, MO (US)

(73) Assignee: TRUE MANUFACTURING CO., INC., O'Fallon, MO (US)

( * ) Notice: Subject to any disclaimer, the term of this patent is extended or adjusted under 35 U.S.C. 154(b) by 389 days.

(21) Appl. No.: 16/746,835

(22) Filed: Jan. 18, 2020

(65) Prior Publication Data

US 2021/0222940 A1 Jul. 22, 2021

(51) Int. Cl.
*F25C 5/20* (2018.01)

(52) U.S. Cl.
CPC ..... *F25C 5/24* (2018.01); *F25C 2500/02* (2013.01)

(58) Field of Classification Search
CPC .... F25C 5/182; F25C 5/20; F25C 5/24; F25C 2500/02; F25C 1/04; F25C 5/18; F25C 1/00; F25D 23/02; F25D 2323/06; F25D 23/062; F25D 23/063; F25D 23/028; A47F 3/043; E06B 3/385; E06B 3/367; B67D 2210/00041; B67D 1/0889
USPC ..... 312/405, 278, 326, 328
See application file for complete search history.

(56) References Cited

U.S. PATENT DOCUMENTS 2,723,536 A 11/1955 Mason
3,171,266 A 3/1965 Louis
3,430,452 A 3/1969 Dedricks et al.
3,731,496 A 5/1973 Frazier
3,788,095 A 1/1974 Grace et al.
3,812,686 A 5/1974 Tester
3,913,349 A 10/1975 Johnson
5,479,707 A 1/1996 Alvarez et al.
5,922,030 A 7/1999 Shank et al.
6,030,064 A * 2/2000 Kim ..... E05D 7/0423 312/405

(Continued)

FOREIGN PATENT DOCUMENTS

CN 107218750 A * 9/2017
GB 1244831 9/1971

(Continued)

OTHER PUBLICATIONS

US 10,852,003 B2, 12/2020, Stroh (withdrawn)

(Continued)

*Primary Examiner* — Cassey D Bauer
(74) *Attorney, Agent, or Firm* — Stinson LLP

(57) ABSTRACT

An ice maker includes a prefabricated cabinet with a base that defines a bottom of an ice maker housing. An access side of the cabinet defines a doorway for accessing an ice making device in the housing. A prefabricated door for opening and closing the doorway has a bottom spaced apart above the bottom of the housing. The ice maker can be mounted on a prefabricated receptacle so that the bottom of the housing is flush with a top of the receptacle and the door can clear a protruding dispenser unit as it swings on its hinge. The prefabricated cabinet may include a door mount that couples the door to the cabinet so that the bottom of the door is spaced above the bottom of the ice maker.

24 Claims, 19 Drawing Sheets

(56) References Cited

U.S. PATENT DOCUMENTS 6,058,732 A 5/2000 Kato et al.
6,105,385 A 8/2000 Kato et al.
6,109,055 A 8/2000 Kato et al.
6,128,807 A * 10/2000 Lim ..... E05D 7/1016 16/266
6,196,007 B1 3/2001 Schlosser et al.
6,209,340 B1 4/2001 Lu
6,257,009 B1 7/2001 Tsuchikawa
6,324,855 B1 12/2001 Mullis
6,418,736 B1 7/2002 Cover
6,453,696 B1 9/2002 Kawasumi et al.
6,463,746 B1 10/2002 Bethuy et al.
6,484,530 B1 11/2002 Hobino et al.
6,607,096 B2 8/2003 Glass et al.
6,612,126 B2 9/2003 Kawasumi et al.
6,637,227 B2 10/2003 Stensrud et al.
6,668,575 B2 12/2003 Stensrud et al.
6,681,580 B2 1/2004 Shedivy et al.
6,705,107 B2 3/2004 Schlosser et al.
6,761,036 B2 7/2004 Teague et al.
6,821,362 B2 11/2004 Satou
6,854,277 B2 2/2005 Gist et al.
6,880,358 B2 4/2005 Lucas et al.
6,907,744 B2 6/2005 Miller et al.
7,010,932 B2 3/2006 Kuroyanagi et al.
7,017,355 B2 3/2006 Allison et al.
D526,338 S 8/2006 McDougal et al.
7,168,262 B2 1/2007 Hirano et al.
D537,457 S 2/2007 McDougal et al.
D540,830 S 4/2007 Gunshi
7,197,889 B2 4/2007 Wakatsuki et al.
7,204,091 B2 4/2007 Mlison et al.
7,273,990 B2 9/2007 Yoshida et al.
7,281,386 B2 10/2007 McDougal et al.
7,284,391 B2 10/2007 Miller et al.
7,287,671 B2 10/2007 Morrow, Sr. et al.
D557,716 S 12/2007 Okuda
7,343,749 B2 3/2008 Fuschikawa et al.
7,444,828 B2 11/2008 Kadowaki et al.
7,444,829 B2 11/2008 Mori et al.
D597,107 S 7/2009 Ohtake
7,779,641 B2 8/2010 Lee et al.
7,802,444 B2 9/2010 Landers et al.
7,832,219 B2 11/2010 Baranowski et al.
7,975,497 B2 7/2011 Kaga et al.
7,980,090 B2 7/2011 Lanzani
8,042,344 B2 10/2011 Morimoto et al.
D649,565 S 11/2011 LaFond et al.
8,087,533 B2 1/2012 Sellers
D653,682 S 2/2012 Herning et al.
8,136,365 B2 3/2012 Kaga et al.
8,230,696 B2 7/2012 Yamaguchi et al.
D668,272 S 10/2012 Ebelt et al.
D668,275 S 10/2012 LaFond et al.
D669,920 S 10/2012 LaFond et al.
8,303,059 B2 * 11/2012 Darney ..... E05D 3/18 312/405
D673,185 S 12/2012 LaFond et al.
8,336,741 B2 12/2012 Graviss et al.
8,341,968 B2 1/2013 Landers et al.
8,375,738 B2 2/2013 Kawasumi et al.
8,387,826 B2 3/2013 Tsubouchi et al.
8,474,282 B2 * 7/2013 Hsiao ..... F25D 21/14 62/285
8,484,935 B2 7/2013 LeBlanc et al.
8,505,595 B2 8/2013 Bragg et al.
8,528,357 B2 9/2013 Kondo et al.
D690,743 S 10/2013 Lafond et al.
D692,032 S 10/2013 LaFond et al.
8,567,013 B2 10/2013 Yamaoka et al.
8,677,774 B2 3/2014 Yamaguchi et al.
8,677,777 B2 3/2014 Yamaguchi et al.
D705,825 S 5/2014 Lafond et al.
8,738,302 B2 5/2014 Tirumala et al.
8,763,851 B2 7/2014 Jiang et al.
8,844,312 B2 9/2014 Yoshida et al.
8,899,072 B2 * 12/2014 Veettil ..... F25C 5/182 62/464
9,038,410 B2 5/2015 Erbs et al.
D734,783 S 6/2015 Yong et al.
9,052,130 B2 6/2015 Schlosser
9,061,881 B2 6/2015 Brown et al.
D734,371 S 7/2015 Lei et al.
9,097,450 B2 8/2015 Kim et al.
9,126,815 B2 9/2015 Cooper et al.
9,146,049 B2 9/2015 Yamaguchi et al.
9,151,528 B2 10/2015 Erbs et al.
9,188,378 B2 11/2015 Maples
9,217,597 B2 12/2015 Mueller et al.
9,243,833 B2 1/2016 Yun et al.
9,316,426 B2 4/2016 Almblad
9,346,659 B2 5/2016 Brown
9,351,571 B2 5/2016 Myers et al.
9,389,009 B2 7/2016 Olson, Jr. et al.
9,625,199 B2 4/2017 Antoine et al.
9,643,828 B2 5/2017 Brown et al.
9,644,879 B2 * 5/2017 Broadbent ..... F25C 5/185
9,803,907 B2 10/2017 Erbs et al.
9,933,195 B2 4/2018 Roth et al.
9,939,186 B2 4/2018 Roth et al.
10,001,306 B2 6/2018 Litchy et al.
10,059,580 B2 8/2018 Wyatt et al.
10,107,540 B2 10/2018 Olson, Jr. et al.
10,156,393 B2 12/2018 Tarr et al.
10,254,032 B2 4/2019 Knatt
10,264,943 B2 4/2019 Toga et al.
10,266,383 B2 4/2019 Haskayne
10,274,239 B2 4/2019 Kobayashi et al.
10,300,161 B2 5/2019 Erbs
10,480,843 B2 11/2019 Short et al.
10,731,864 B2 8/2020 Wild
10,801,770 B2 10/2020 Broadbent
10,829,347 B2 11/2020 Rudy et al.
10,866,020 B2 12/2020 Hoti et al.
10,935,304 B1 * 3/2021 Hawley, III ..... F25D 21/14
2003/0010055 A1 1/2003 Kuroyanagi et al.
2003/0205051 A1 11/2003 Kilawee et al.
2006/0026985 A1 * 2/2006 Hollen ..... F25D 21/14 62/340
2009/0179040 A1 7/2009 Hawkins
2014/0137593 A1 5/2014 Broadbent
2014/0137594 A1 5/2014 Broadbent
2014/0137984 A1 5/2014 Broadbent
2014/0144175 A1 5/2014 Broadbent
2014/0208781 A1 7/2014 Broadbent
2014/0208792 A1 7/2014 Broadbent
2014/0209125 A1 7/2014 Broadbent
2014/0216071 A1 8/2014 Broadbent
2015/0192338 A1 7/2015 Knatt
2015/0377538 A1 12/2015 Rockwell
2016/0007801 A1 1/2016 Bressner et al.
2016/0016133 A1 1/2016 Merritt et al.
2016/0045063 A1 2/2016 Mantle et al.
2016/0054043 A1 2/2016 Broadbent
2016/0054044 A1 2/2016 Jeong et al.
2016/0095450 A1 4/2016 Trulaske, Sr.
2016/0159520 A1 6/2016 Vemula et al.
2016/0290697 A1 10/2016 Broadbent et al.
2016/0298893 A1 10/2016 Knatt et al.
2016/0327352 A1 11/2016 Broadbent et al.
2016/0334157 A1 11/2016 Broadbent et al.
2016/0370061 A1 12/2016 Erbs
2017/0003062 A1 1/2017 Olson, Jr. et al.
2017/0023284 A1 1/2017 Broadbent
2017/0067678 A1 3/2017 Melton et al.
2017/0176077 A1 6/2017 Knatt
2017/0183210 A1 6/2017 Wyatt et al.
2017/0370628 A1 12/2017 Knatt
2018/0017304 A1 1/2018 Knatt
2018/0023847 A1 1/2018 Kobayashi et al.
2018/0023874 A1 1/2018 Kobayashi et al.
2018/0031294 A1 2/2018 Olson, Jr. et al.
2018/0106521 A1 4/2018 Broadbent et al.
2018/0142932 A1 5/2018 Knatt et al.

(56) References Cited

U.S. PATENT DOCUMENTS

| | | | |
|---|---|---|---|
| 2018/0283760 | A1 | 10/2018 | Knatt et al. |
| 2018/0313593 | A1 | 11/2018 | Olvera et al. |
| 2019/0008004 | A1 | 1/2019 | Wild |
| 2020/0400358 | A1 | 12/2020 | Romagnoli |

FOREIGN PATENT DOCUMENTS

| | | | |
|---|---|---|---|
| JP | H08285419 | A | 11/1996 |
| JP | 2006010181 | A | 1/2006 |
| WO | 2000075579 | A1 | 12/2000 |
| WO | 20150065564 | A1 | 5/2015 |
| WO | 20150171121 | A1 | 11/2015 |
| WO | 20160007738 | A1 | 1/2016 |
| WO | 20160011103 | A1 | 1/2016 |
| WO | 20160025845 | A1 | 2/2016 |
| WO | 20160057064 | A1 | 4/2016 |
| WO | 201600654866 | A1 | 4/2016 |
| WO | 20160089410 | A1 | 6/2016 |
| WO | 201600146082 | A1 | 9/2016 |
| WO | 20160181702 | A1 | 11/2016 |
| WO | 20160205685 | A1 | 12/2016 |
| WO | 20170004212 | A1 | 1/2017 |
| WO | 20170077295 | A1 | 5/2017 |
| WO | 20170083359 | A1 | 5/2017 |
| WO | 2017095691 | A1 | 6/2017 |
| WO | 2017102494 | A1 | 6/2017 |
| WO | 2017162680 | A1 | 9/2017 |
| WO | 2017180578 | A1 | 10/2017 |
| WO | 2017182214 | A1 | 10/2017 |
| WO | 2018007318 | A1 | 1/2018 |
| WO | 20180011711 | A1 | 1/2018 |
| WO | 20180022097 | A1 | 2/2018 |
| WO | 20180147843 | A1 | 8/2018 |
| WO | 20180148096 | A1 | 8/2018 |
| WO | 2018158186 | A1 | 9/2018 |
| WO | 2019143354 | A1 | 7/2019 |
| WO | 2019164480 | A1 | 8/2019 |

OTHER PUBLICATIONS

Extended European Search Report, received from counterpart European Patent No. 21151948.3-1009, dated Jun. 14, 2021, 13 pages.

* cited by examiner

ICE MAKER, ICE DISPENSING ASSEMBLY, AND METHOD OF DEPLOYING ICE MAKER

FIELD

The present disclosure generally relates to an ice maker, an ice dispensing assembly including an ice maker and an ice dispenser, and a method of deploying an ice maker on an ice receptacle.

BACKGROUND

Commercial ice makers are well-known and in extensive use in restaurants, hotels, offices, schools, and the like. A typical commercial ice maker includes an ice making device received in a housing. The housing often comprises a cabinet with an open bottom. The ice making device is located in the interior of the cabinet such that the ice making device can drop ice through the open bottom. The cabinet is typically mounted above an ice receptacle, for example, an ice receptacle of an ice dispenser. The cabinet includes a doorway, and a door is connected to the cabinet for closing the doorway. The door may be opened to access the ice making device through the doorway for maintenance or repair.

SUMMARY

In one aspect, an ice maker for making ice comprises an ice making device configured to form ice pieces. A housing is configured to be mounted on an ice receptacle. The ice making device is received in the housing. The housing comprises a prefabricated cabinet including a base that defines a bottom of the housing. The base defines at least one opening through which the ice pieces formed by the ice making device are passable into the ice receptacle when the prefabricated housing is mounted on the ice receptacle. The cabinet has an access side extending up from the base and defining a doorway for accessing the ice making device. A prefabricated door is connected to the prefabricated cabinet for movement relative to the prefabricated cabinet between an open position and a closed position. The prefabricated door closes the doorway in the closed position and opens the doorway in the open position. The prefabricated door has a height and a bottom and a top spaced apart along the height. The bottom of the prefabricated door is spaced apart above the bottom of the housing in the closed position.

In another aspect, a method of deploying an ice maker comprises receiving an ice maker comprising a prefabricated cabinet having an ice making device therein and a prefabricated door configured to be connected to the prefabricated cabinet for selectively opening and closing the cabinet. The prefabricated cabinet comprises a base that defines a bottom of the prefabricated cabinet. The ice maker is configured so that a bottom of the prefabricated door is spaced apart above the bottom of the prefabricated cabinet when the prefabricated door is connected to the prefabricated cabinet and positioned in a closed position. The prefabricated cabinet is mounted directly on a prefabricated ice receptacle such that the bottom of the prefabricated cabinet is substantially flush with a top of the prefabricated ice receptacle.

In another aspect, an ice maker for making ice comprises an ice making device configured to form ice pieces. A prefabricated cabinet is configured to be mounted on the ice receptacle. The ice making device is received in the prefabricated cabinet. The prefabricated cabinet includes a base that defines a bottom of the prefabricated cabinet. The base defines at least one opening through which the ice pieces formed by the ice making device are passable into the ice receptacle when the prefabricated cabinet is mounted on the ice receptacle. The prefabricated cabinet has a doorway for accessing the ice making device at least partially above the base. The prefabricated cabinet includes a door mount adjacent to the doorway. A prefabricated door includes a connector configured to connect to the door mount to mount the prefabricated door on the prefabricated cabinet such that the prefabricated door is movable relative to the prefabricated cabinet between an open position and a closed position. The prefabricated door has a bottom that is spaced apart above the bottom of the prefabricated cabinet when the prefabricated door is mounted on the prefabricated cabinet by the connector connected to the door mount and the prefabricated door is positioned in the closed position.

Other aspects will be in part apparent and in part pointed out hereinafter.

BRIEF DESCRIPTION OF THE DRAWINGS

Corresponding reference characters indicate corresponding parts throughout the drawings.

DETAILED DESCRIPTION

Figure 1:
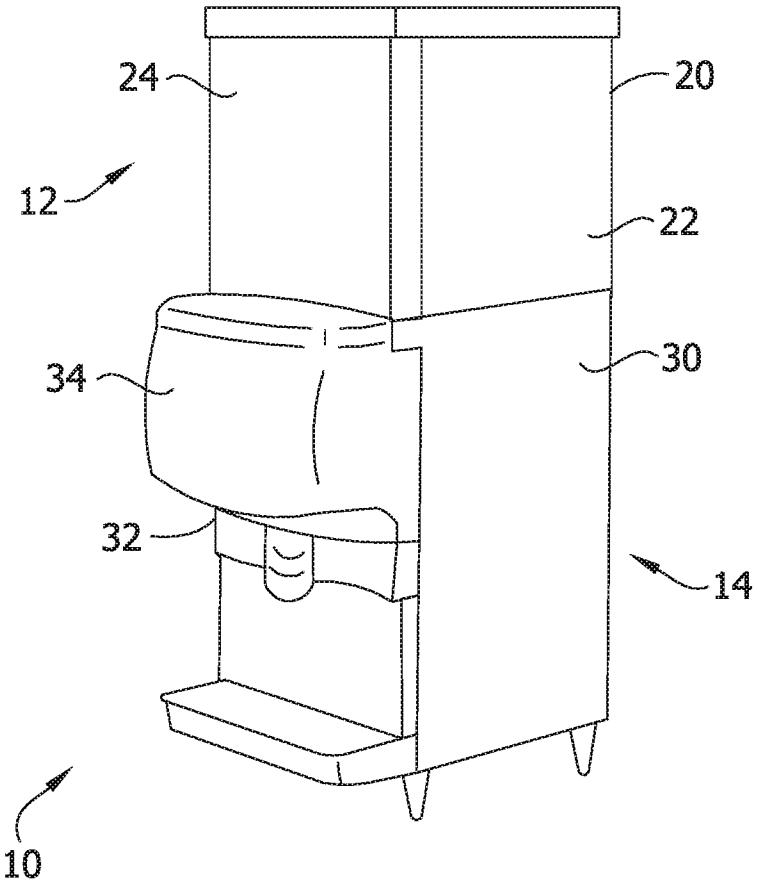
FIG. 1 Prior Art
FIG. 1 is a perspective of a prefabricated ice maker of the prior art mounted directly on an ice dispenser.

Referring to FIG. 1, an ice dispensing assembly of the prior art is generally indicated at reference number 10. The ice dispensing assembly 10 generally includes a prefabricated ice maker 12 and a prefabricated ice dispenser 14 (broadly, an ice receptacle). Throughout this disclosure, "prefabricated" refers a final state of assembly of an article at an offsite production facility that is remote from the location at which the article is deployed or installed. In other words, a prefabricated article (e.g., a prefabricated ice maker, a prefabricated ice receptacle, or any prefabricated component) is made at a production, assembly or other facility and is later shipped (e.g., packaged and shipped) to a remote location where the prefabricated article is deployed or installed (e.g., unpackaged and used). (It will be appreciated that oftentimes prefabricated articles are shipped multiple times before deployment, e.g., from manufacturer to distributer, from distributor to retailer, and from retailer to ultimate purchaser.) The characteristics of the prefabricated article endure from the production, assembly or other facility to the place of deployment or installment. Post-production modifications, i.e., modifications made at locations remote from the production facility such as at the deployment or installment location, are not part of the prefabricated article for purposes of this disclosure.

Commercial ice makers and ice dispensers, as well as other types of ice receptacles (e.g., ice bins), are frequently manufactured separately, as discrete prefabricated units. Prefabricated ice makers and ice receptacles may be manufactured or assembled at the same or different production or assembly facilities within the scope of this disclosure. In one or more embodiments, a prefabricated ice maker is deployed or installed at the location where it is mounted on an ice receptacle for making ice and depositing the ice into the receptacle. Conversely, a prefabricated ice receptacle is deployed or installed at the location where an ice maker is mounted on the receptacle. Referring still to FIG. 1, the prefabricated ice maker 12 and a prefabricated ice dispenser 14 were manufactured or assembled separately (at the same production or assembly facility or different production or assembly facilities) and then deployed or installed for use together at a site remote from the production facility(ies), e.g., a restaurant, an office, a hotel, or a school.

Generally, the ice maker 12 comprises a prefabricated housing 20 configured to receive an ice making device (not shown) therein. The housing 20 includes a cabinet 22 and a door 24 connected to the cabinet for movement relative to the cabinet from a closed position to an open position. The door 24 of the prior art housing 20 has a full overlay configuration so that the door forms a seal across the entire doorway of the cabinet 24 when the door is closed, as shown in FIG. 1. In the prefabricated ice maker 12, the cabinet 22 defines the bottom of the housing 20 and the door 24 is mounted on the cabinet such that the bottom of the door is vertically aligned with the bottom of the housing.

The ice dispenser 14 comprises a prefabricated ice receptacle 30 and a prefabricated ice dispensing unit 32. The ice dispensing unit is located on the front of the ice receptacle 30 and includes a dispensing unit enclosure 34 having a top end portion that protrudes above the top of the ice receptacle. In FIG. 1 the prefabricated ice maker 12 is mounted directly on the prefabricated ice receptacle 30 such that the bottom of the housing 20 is substantially flush with the top of the ice receptacle. As shown, in this configuration the protruding top end portion of the dispensing unit enclosure 32 blocks the ice maker door 24 from opening. The ice maker 20 must be lifted up off of the ice receptacle 30 to open the door 24 any time access to the interior of the ice maker 12 is required (e.g., to service the ice making device). Having to lift the ice maker 12 up off of the top of the ice receptacle 30 to access the interior of the ice maker housing 20 is inconvenient.

Figure 2:
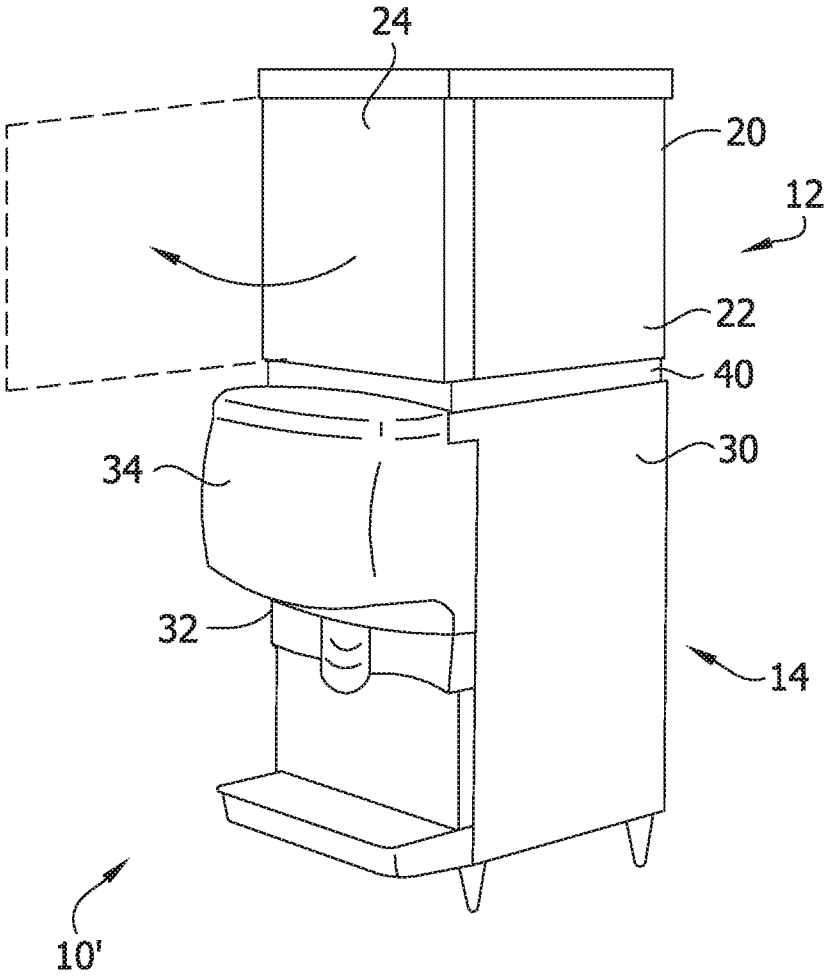
FIG. 2 Prior Art
FIG. 2 is a perspective of the prefabricated ice maker of the prior art mounted on the ice dispenser on shims.

To address this inconvenience, some installers make on-site modifications to the ice dispensing assembly 10. As shown in FIG. 2, it is known to place retrofit shims 40 between the prefabricated ice maker 12 and the prefabricated ice dispenser 14 to form a site-modified ice dispensing assembly 10'. In the site-modified assembly shown in FIG. 2, the door 24 of the ice maker 12 is spaced apart above the top of the dispensing unit enclosure 34 so that the door can clear the dispenser when moving between the closed and open positions. However, the shims 40 are not part of the prefabricated ice maker 12 or dispenser 14 and typically lack the desired fit and finish. Moreover, the inventors have recognized that using shims 40 can lead to improper mounting of the ice maker 12, which can adversely affect the performance of the ice maker and/or the ice dispenser 14.

Figure 3:
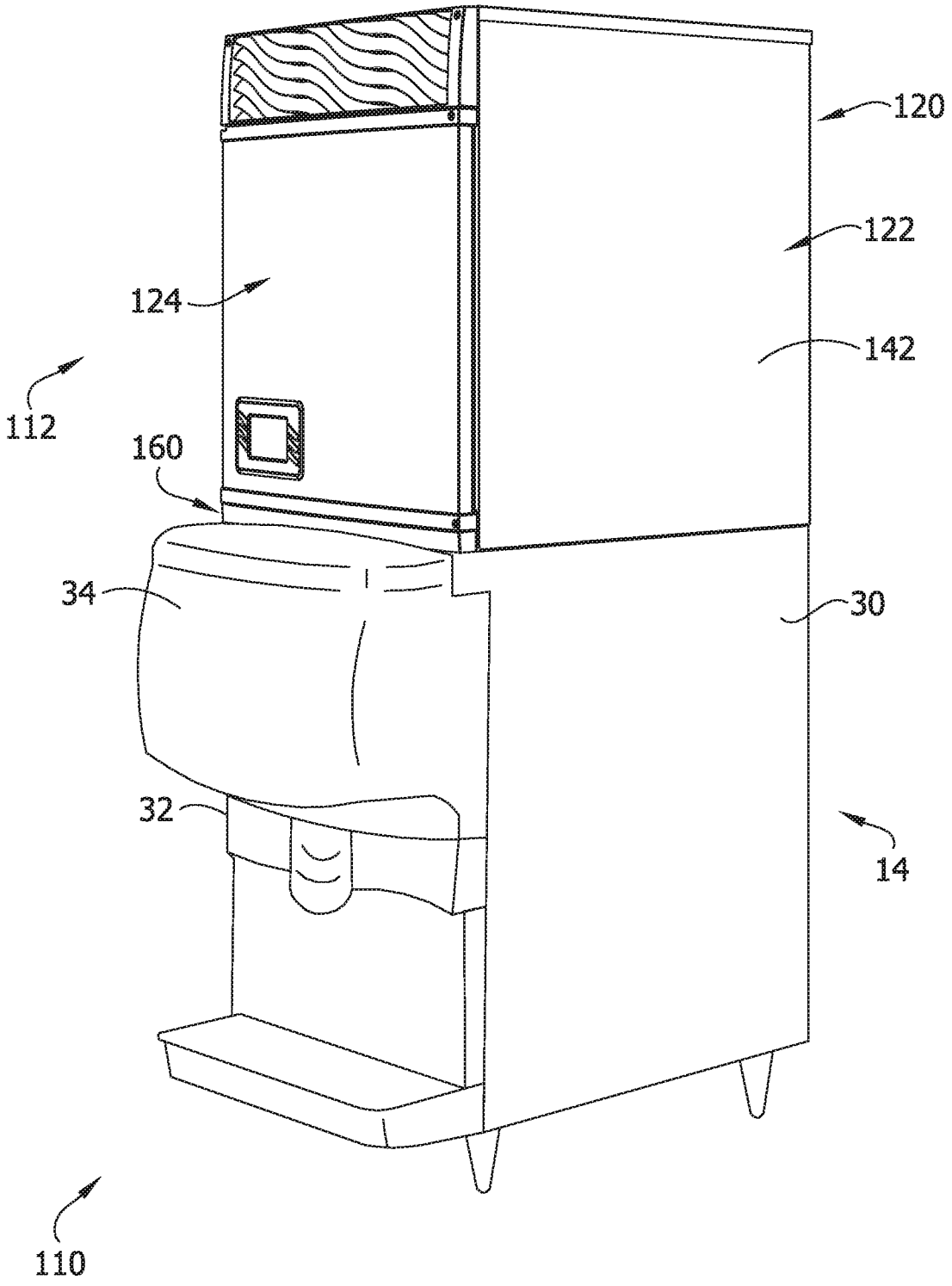
FIG. 3 is a perspective of a prefabricated ice maker in the scope of the present disclosure mounted directly on the ice maker, showing a door of the ice maker in a closed position.
Figure 4:
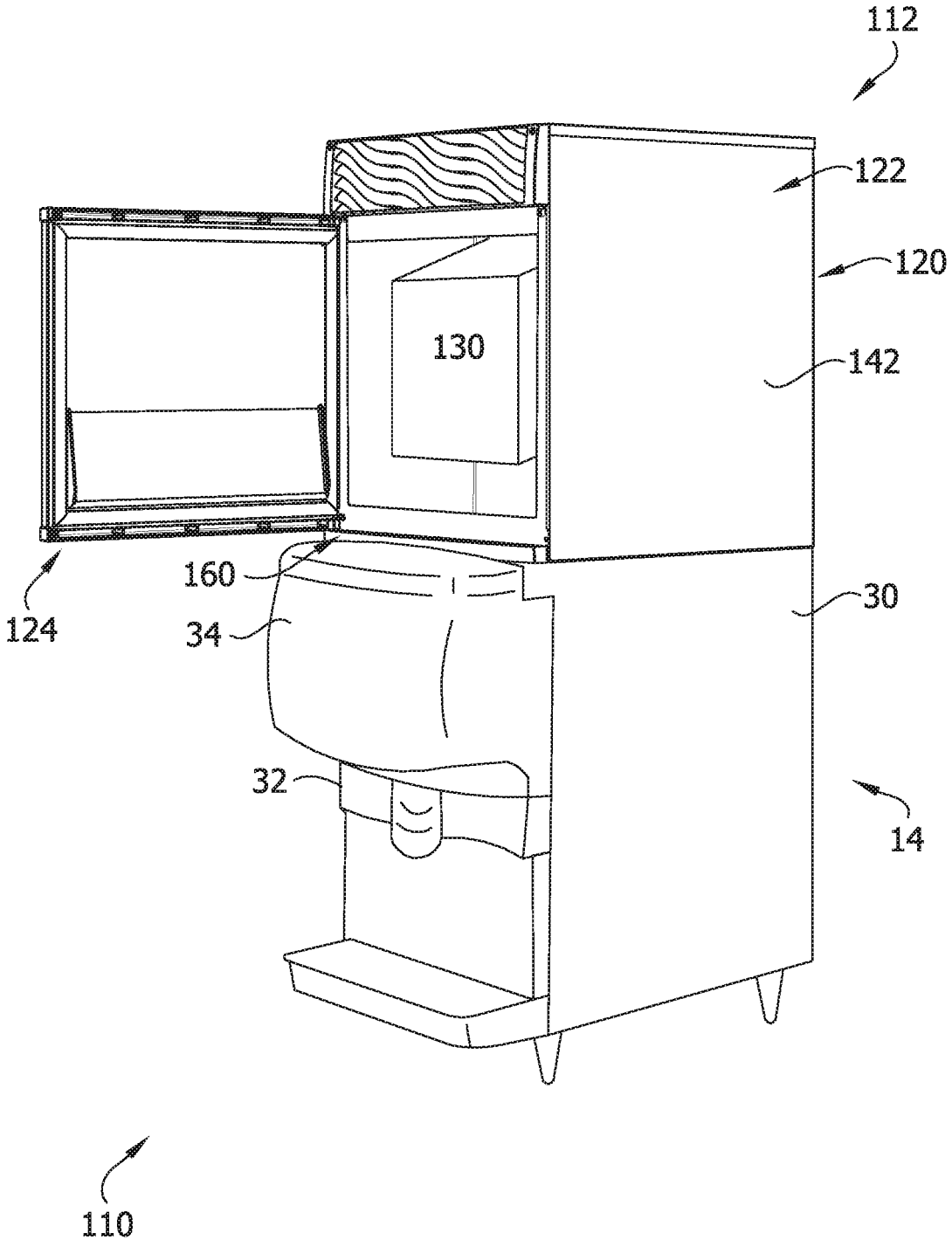
FIG. 4 is a perspective similar to FIG. 3 but showing the door in an open position.
Figure 8:
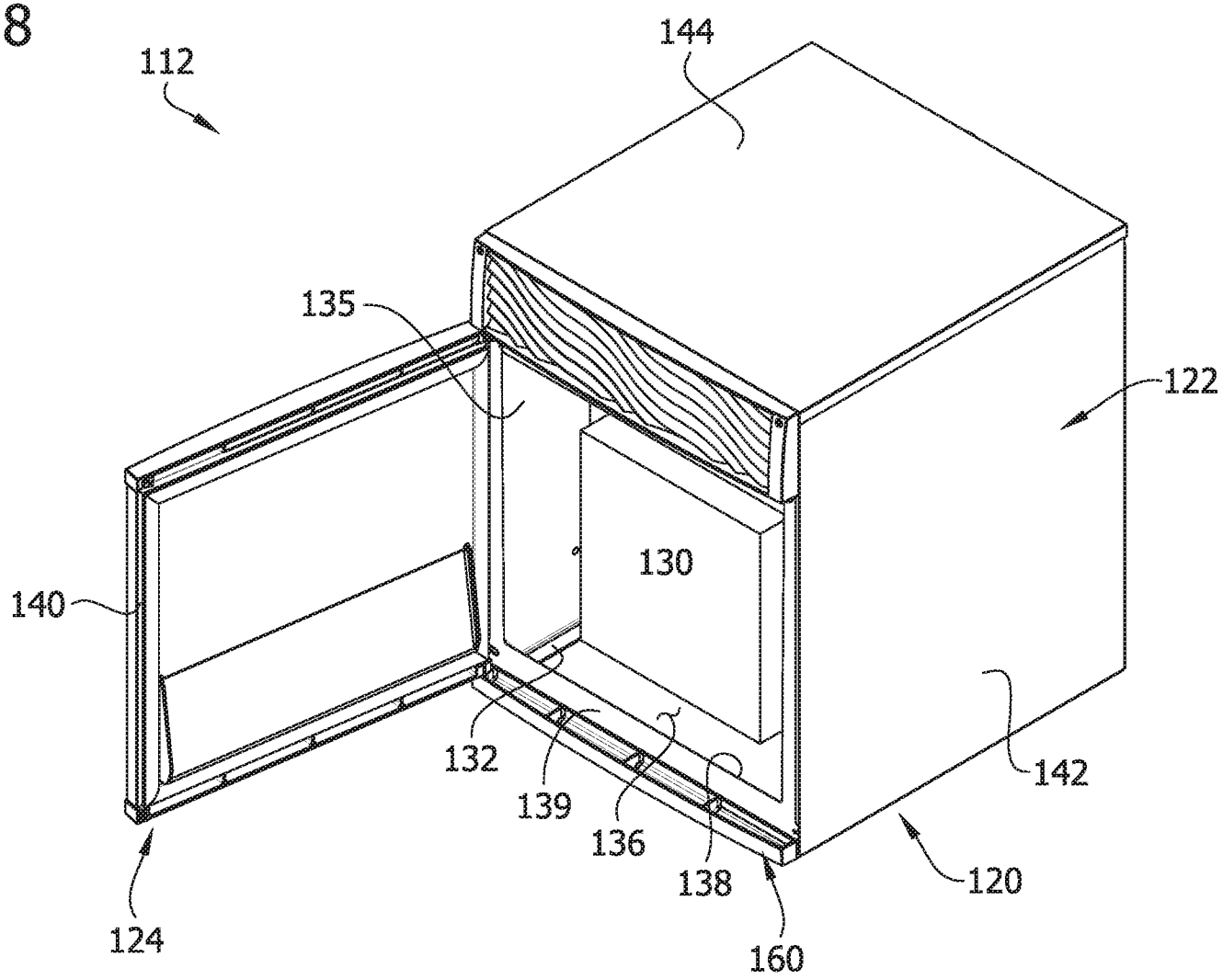
FIG. 8 is a perspective of the ice maker of FIG. 3 with the door in the open position.
Figure 9:
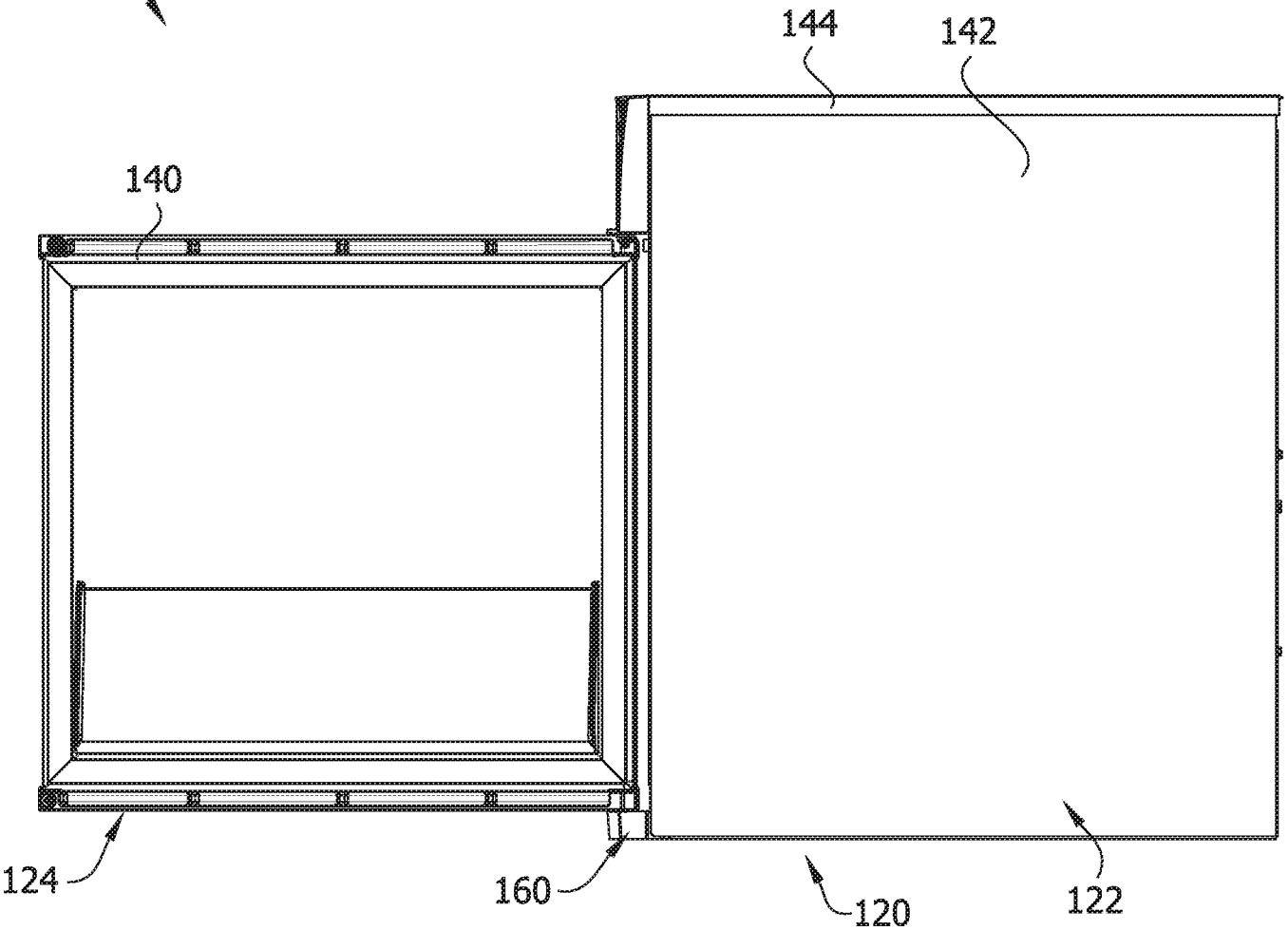
FIG. 9 is a side elevation of the ice maker of FIG. 3 with the door in the open position.

Referring to FIGS. 3-9, one embodiment of an ice maker (e.g., a prefabricated ice maker) in the scope of this disclosure is generally indicated at reference number 112. Generally, the ice maker 112 comprises a housing 120 (e.g., a prefabricated housing) that includes a prefabricated cabinet 122 and a prefabricated door 124 connected to the cabinet for movement between a closed position (FIGS. 3 and 5-7) and an open position (FIGS. 4 and 8-9). As shown in FIGS. 3 and 4, the housing 120 is configured to be mounted directly on top of an ice receptacle. For example, in one or more embodiments, the housing 120 is mounted directly on the ice receptacle 30 of the dispenser 14 to form an ice dispensing assembly 110. As will be explained in further detail below, unlike the prior art ice maker 12, when the housing 120 of the ice maker 112 is mounted directly on the ice dispenser receptacle 30, the door 124 can be opened without interfering with the protruding upper end portion of the dispensing unit enclosure 34. No retrofit parts or site modifications are required to enable the door 124 to clear the enclosure 34.

Referring to FIGS. 4 and 8, an ice making device 130 configured for making pieces of ice (not shown), shown schematically, is received in the interior of the ice maker housing 120. Any suitable ice making device 130 can be used without departing from the scope of the invention. Broadly speaking, an ice making device 130 can include an ice form, a water system configured to impart water onto the ice form, and a refrigeration system configured to cool the ice form to change the water into ice.

In an embodiment, the ice making device 130 comprises a cube-type ice making device that includes a generally vertical freeze plate (broadly, an ice form) defining a plurality of ice molds in thermal communication with an evaporator of the refrigeration system. As is known to those skilled in the art, during ice making cycles, the water system in these types of ice making devices circulates water from a sump through a distributor onto the top of the freeze plate. The water then flows downward along the freeze plate. Some of the flowing water freezes into ice and unfrozen water flows from the freeze plate back into the sump. When the desired amount of ice is formed on the freeze plate, the ice making device enters a harvest cycle which causes the ice to separate from the freeze plate. In one embodiment, the harvest cycle is initiated by redirecting warm refrigerant gas from the outlet of the evaporator to the inlet of the evaporator (instead of to a condenser), which causes some of the ice to melt until the ice separates from the freeze plate. An exemplary embodiment of a cube-type ice making device in the scope of this disclosure is described in U.S. Patent Application Publication No. 2016/0327352, which is hereby incorporated by reference in its entirety.

In certain embodiments, the ice making device 130 comprises a flake- or nugget-type ice making device. As is known to those skilled in the art, such an ice making device comprises a cylindrical ice making chamber (broadly, an ice form) surrounded by an evaporator of the refrigeration system. The water system is configured to deliver water into the ice making chamber, and the evaporator is configured to cool the water into ice. A rotatable auger positioned inside the ice making chamber rotates to drive ice that forms on the inner wall of the ice making chamber out of the top of the chamber. An exemplary embodiment of a flake- or nugget-type ice making device in the scope of this disclosure is described in U.S. Patent Application Publication No. 2016/0327352, which is hereby incorporated by reference in its entirety.

In one or more embodiments, the ice making device 130 comprises a vertical spray-type ice making device. As is known in the art, such an ice making device comprises a freeze plate thermally coupled to an evaporator of the refrigeration system and oriented generally horizontally such that molds face downward. During an ice making cycle, the water system sprays water vertically into the downward facing molds, and the refrigeration system cools the molds via the evaporator. Some of the water forms into ice in the molds, and the portion of the water that does not form into ice falls from the freeze plate, through a porous chute below the freeze plate, into a sump. The water system continuously recirculates the water in the sump, spraying it vertically into the molds. When the desired amount of ice forms in the molds, the vertical spray-type ice making device begins a harvest cycle to separate the ice from the molds. Like the cube-type ice maker described above, the harvest cycle can involve redirecting warm refrigerant gas from the outlet of the evaporator to the inlet of the evaporator to warm the freeze plate and partially melt the ice. The separated ice falls from the freeze plate onto the porous chute and the slides off of the porous chute. An exemplary embodiment of a vertical spray-type ice making device in the scope of this disclosure is described in U.S. Pat. No. 10,254,032, which is hereby incorporated by reference in its entirety.

Figure 10:
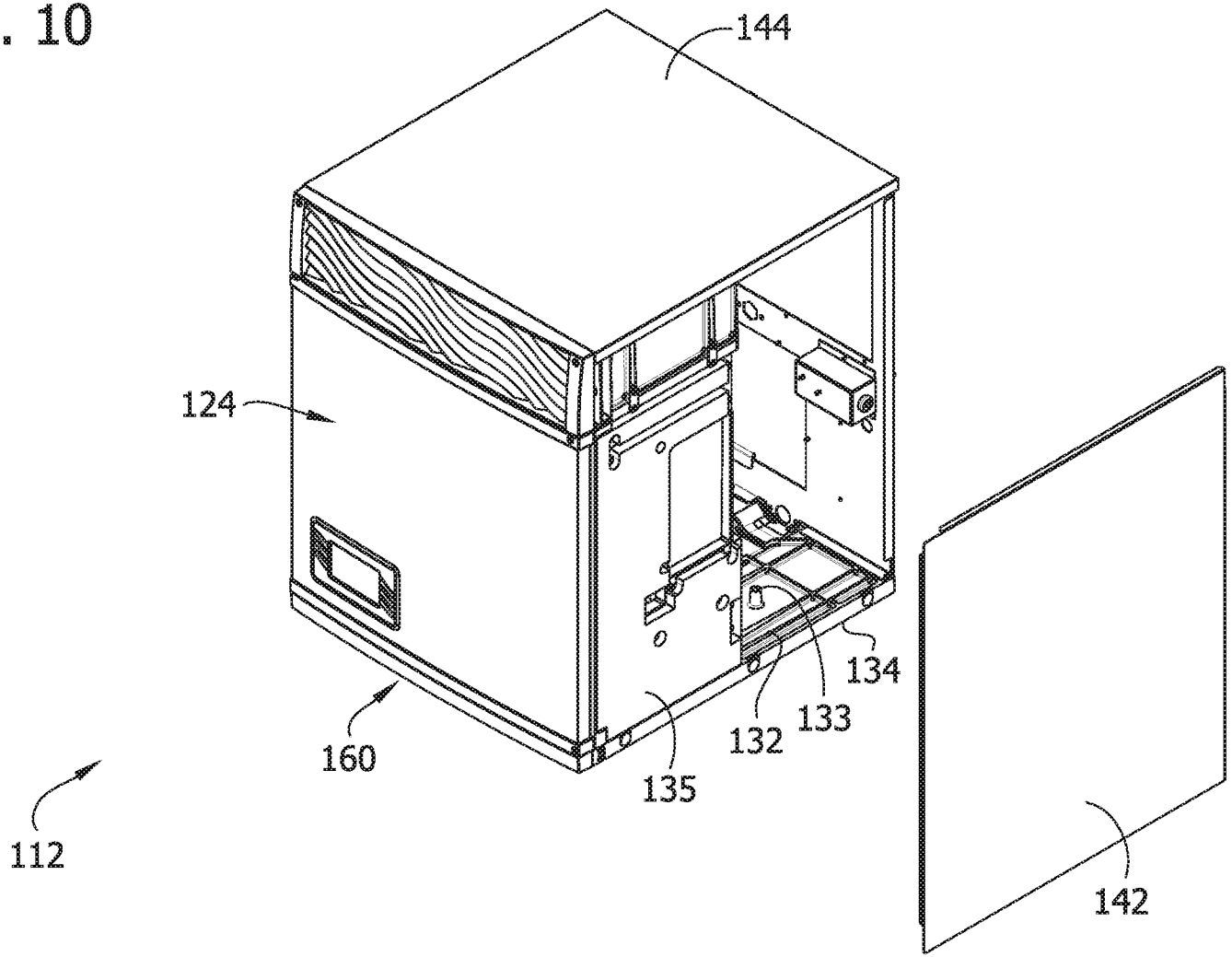
FIG. 10 is a perspective of the ice maker of FIG. 3 with a side panel separated from a remainder of the ice maker.
Figure 11:
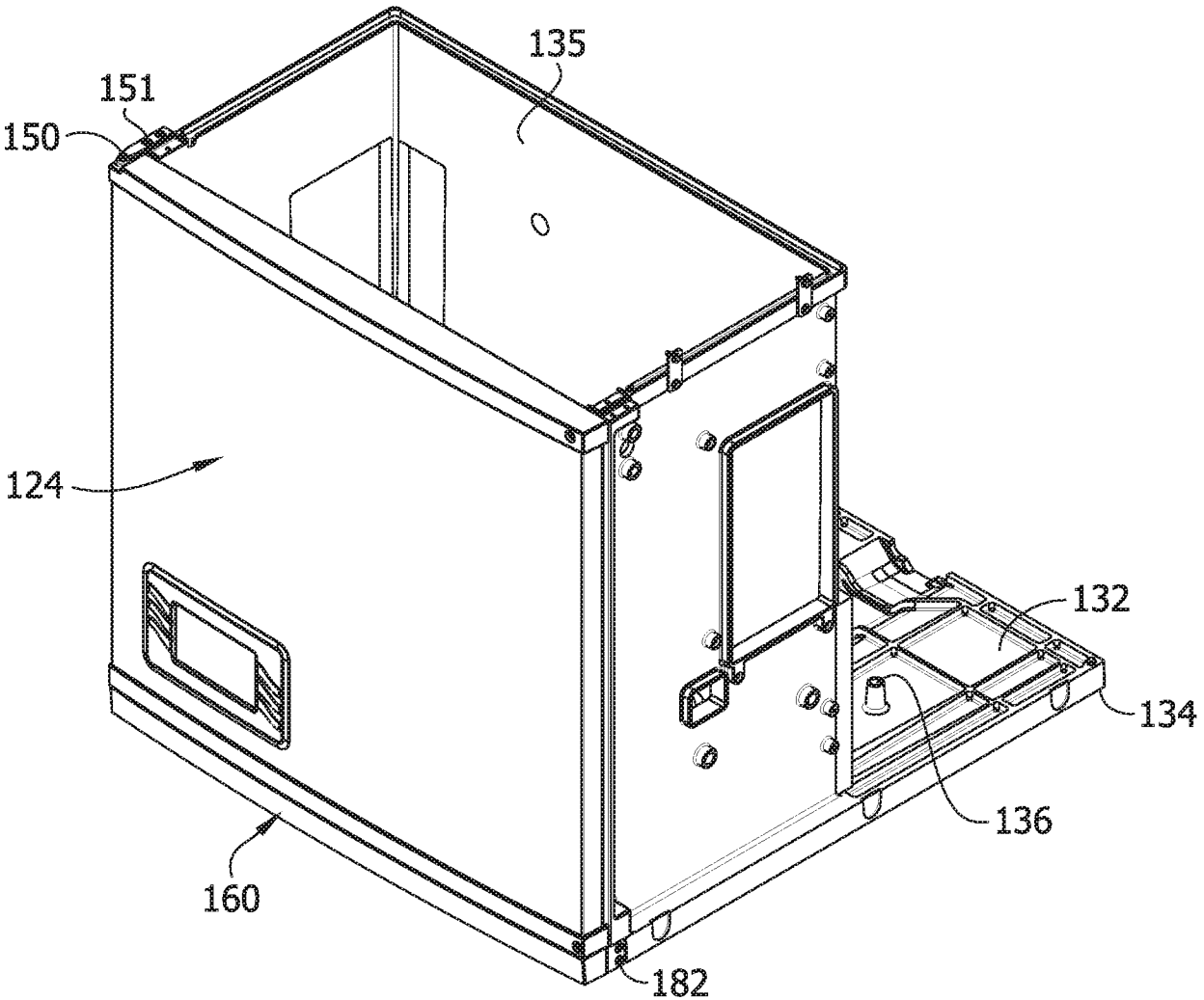
FIG. 11 is a perspective of a subassembly of the ice maker of FIG. 3 including an ice making device support, the door, and a sill.

Referring to FIGS. 5-9, the illustrated ice maker housing 120 has a height H (FIG. 6) that extends from the bottom to a top of the cabinet 122 and a width W (FIG. 6) that extends from a left and to a right side (broadly, first and second lateral sides) of the cabinet. Referring to FIGS. 10-11, the prefabricated cabinet 122 comprises a base 132 (FIG. 10), which defines the bottom of the housing 120. Suitably, the base 132 includes one or more integral mounting formations 133 that can be used to mount the housing 120 on top of the ice receptacle 30 such that the bottom of the housing is substantially flush with the top of the receptacle. For example, the illustrated base 132 includes one or more holes 133 that are configured to receive removable fasteners for fastening the housing onto the receptacle 30. It will be appreciated that an ice maker can attach to an ice receptacle in other ways in other embodiments.

In one embodiment, the base 132 is formed by the bottom wall of a one-piece support 134. The illustrated one-piece support 134 further comprises an integral vertical support wall 135 extending up from the base 132. As shown in FIG. 8, the ice making device 130 is mounted on the vertical support wall 135 at least partially above an opening 136 formed by the base 132. The opening 136 is configured such that ice made by the ice making device 130 is passable through the opening into the ice receptacle 30 when the ice maker 112 is mounted on the ice dispenser 14. Additional framework and cladding are also supported on the one-piece support 134 in the illustrated embodiment to form the remainder of the cabinet 122. However, it will be understood that the prefabricated cabinet could be constructed in other ways in other embodiments.

Referring still to FIG. 8, the front side (broadly, an access side) of the cabinet 122 defines a doorway 138. Suitably, the door 124 is connected to the cabinet 122 to completely cover the doorway 138 in the closed position. When the door 124 is open, a technician can access the ice formation device 130 through the doorway 138 for maintenance and repair. The illustrated doorway 138 is generally rectangular and has a bottom end that is spaced apart above the bottom of the housing 120 (e.g., the bottom end of the doorway is spaced apart above the bottom of the housing by at least about 25 mm, e.g., at least about 40 mm, e.g., at least about 50 mm. A top of the doorway 138 is likewise spaced apart below the top of the ice maker housing 120. In the illustrated embodiment, the front side of the cabinet 124 includes a seat 139 that extends around the perimeter of the doorway 138. When the door 124 is closed, a seal 140 of the door is compressed against the seat 139. Suitably, the seal 140 comprises a gasket that compresses against the seat 139 about the entire perimeter of the doorway 138 when the door 124 is closed to provide a thermal and/or environmental seal of the interface between the door 124 and the cabinet 122.

Figure 5:
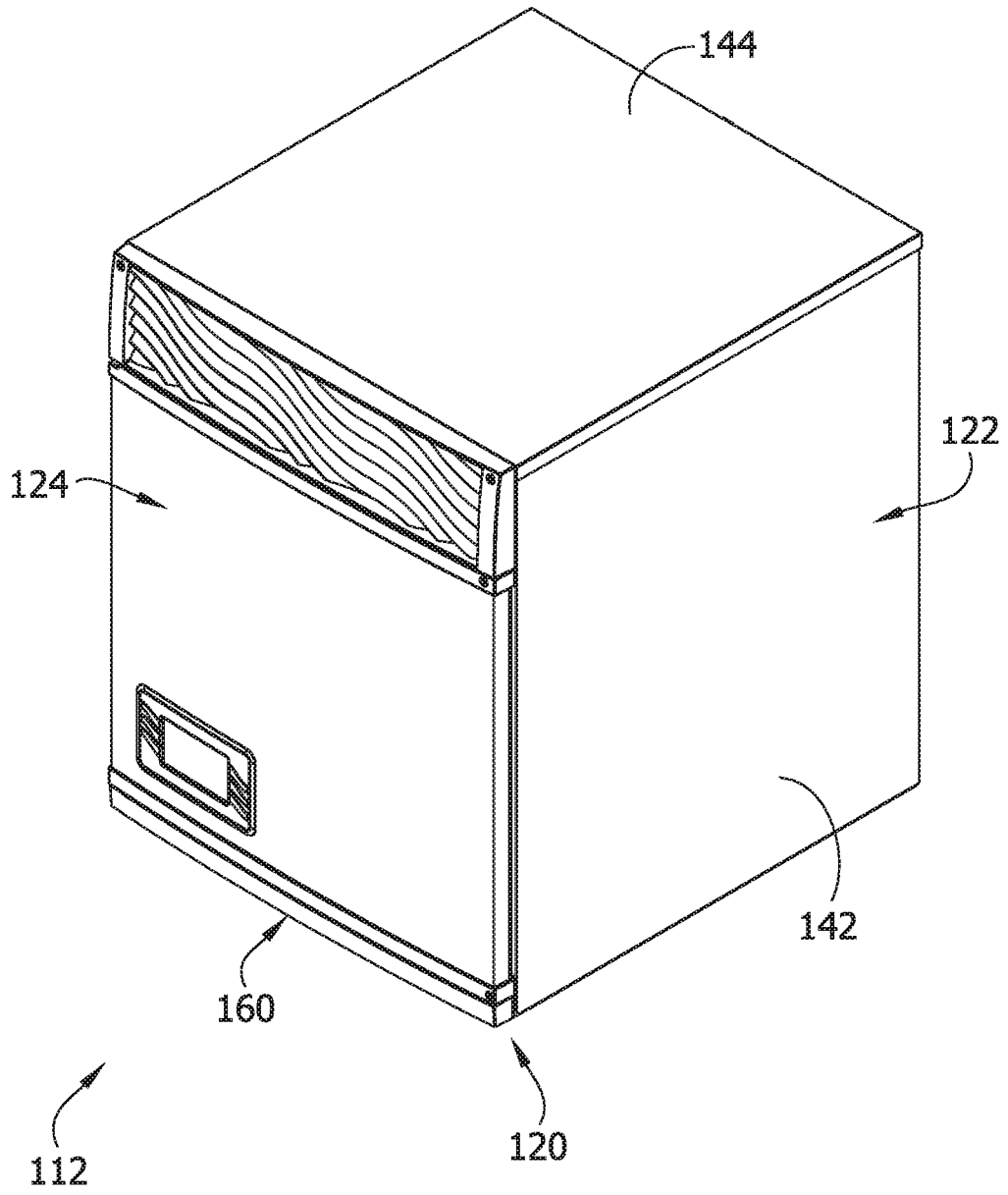
FIG. 5 is a perspective of the ice maker of FIG. 3 with the door in the closed position.

In an embodiment, one or both of the lateral sides of the prefabricated cabinet 122 comprises a one-piece side panel 142 that extends from a top end near the top of the cabinet (e.g., a top end spaced apart above a top of the ice making device 130) to a bottom end that is vertically aligned with the bottom of the ice maker housing 120. The side panels 142 enclose the lateral sides of the cabinet 122 such that the illustrated cabinet comprises an enclosed side adjacent each of the opposite sides of the doorway 138. As can be seen in FIG. 5, the bottom edge margin of each side panel 142 covers a respective lateral side of the base 132. In addition, the side panels 142 protrude downward beyond the bottom end of the door 124 when the door is closed. Moreover, as shown in FIGS. 3 and 4, the bottom edge margins of the side panels 142 are substantially flush with the top of the ice receptacle 30 when the prefabricated housing 120 is mounted on top of the prefabricated ice dispenser 114. Referring again to FIG. 8, in the illustrated embodiment, the side panels 142 extend essentially from the front to the rear of the cabinet 122 and the tops of the side panels adjoin side edges of a top piece 144 of the cabinet 122. As such that side panels 142 provide the sides of the prefabricated ice maker cabinet 122 with a smoothly continuous appearance that is carried downward along the housing 120 to the top of the ice receptacle on which the ice maker 112 is mounted.

Figure 12:
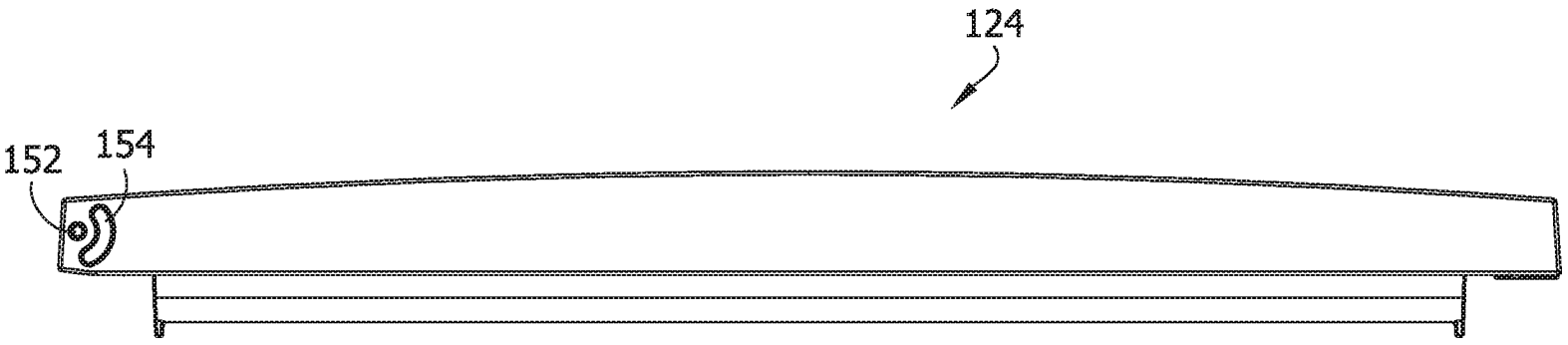
FIG. 12 is a bottom plan view of the door.

Referring to FIGS. 5-9, the door 124 is hingedly connected to the cabinet 122 for movement relative to the cabinet between the open position and the closed position. More specifically, a left side of the illustrated door 124 is hingedly connected to the left side portion of the cabinet 122. In another embodiment, the top, bottom, or right side of the door could be hingedly connected to the cabinet. As shown in FIG. 11, an upper hinge bracket 150 hingedly connects an upper corner of the door 124 directly to the support wall 135. Referring to FIG. 12, a bottom end portion of the door 124 also includes an integral connector for hingedly connecting the bottom end portion of the door to the cabinet 122. Specifically, the bottom end portion of the door 124 includes a pin receiver 152 that is configured to rotatably receive a pin therein as described below. The bottom end portion of the illustrated door 124 further comprises an elongate channel 154 extending lengthwise along an arcuate path generally centered about the pin receiver 152. As will be explained in further detail below, the elongate channel 154 is configured to function as an integral door stop that limits movement of the door in the opening direction.

In an embodiment, the entire ice maker housing 120 is prefabricated. That is, the prefabricated housing 120 includes a prefabricated door 124 that is connected to the prefabricated cabinet 122 at the production facility remote from the site of deployment. However, it is also contemplated that the ice maker 112 can be manufactured in a kit that includes a prefabricated cabinet 122 and separate a prefabricated door 124 that is configured to attach to the prefabricated cabinet to form the housing 120 at the site where the ice maker is deployed. In one embodiment of such a kit, the ice making device 130 is mounted in the prefabricated cabinet 122 at the production facility. Suitably, the prefabricated cabinet 122 comprises an integrated door mount configured to connect to a connector integrated into the prefabricated door 124 to mount the door on the cabinet for movement between the open and closed positions. In the illustrated embodiment, for example, the prefabricated cabinet 122 includes the hinge bracket 150, which is integrated into the prefabricated cabinet to form a door mount configured to connect to a connector of the prefabricated door 124. It is also contemplated that the hinge bracket 150 could be a separate component configured to attach to the cabinet 122 via another integrated door mount during final on-site assembly. For example, in an embodiment, the illustrated hinge 150 connects to the vertical support wall 135 via fasteners 151 that interface with receivers (e.g., screw holes) integrated into the support 134. The receivers for the fasteners 151 can form the integrated door mount of the prefabricated cabinet 122 in one or more embodiments. Still other integrated door mounts (e.g., hinge mortices, hinge pins, hinge pin receivers) can be used without departing from the scope of the invention. The prefabricated door 124 can include an integrated connector (e.g., a hinge pin, a pin receiver, a screw hole, or a hinge mortice) configured to connect the door to the hinge 150 to assemble the housing 120 and mount the door on the prefabricated cabinet 122 for movement between the open and closed position. It can be seen that the door mount integrated into the prefabricated cabinet 122 and the connector integrated into the prefabricated door 124 connect to mount the door on the cabinet such that the bottom of the door is spaced apart from the bottom of the cabinet.

Figure 6:
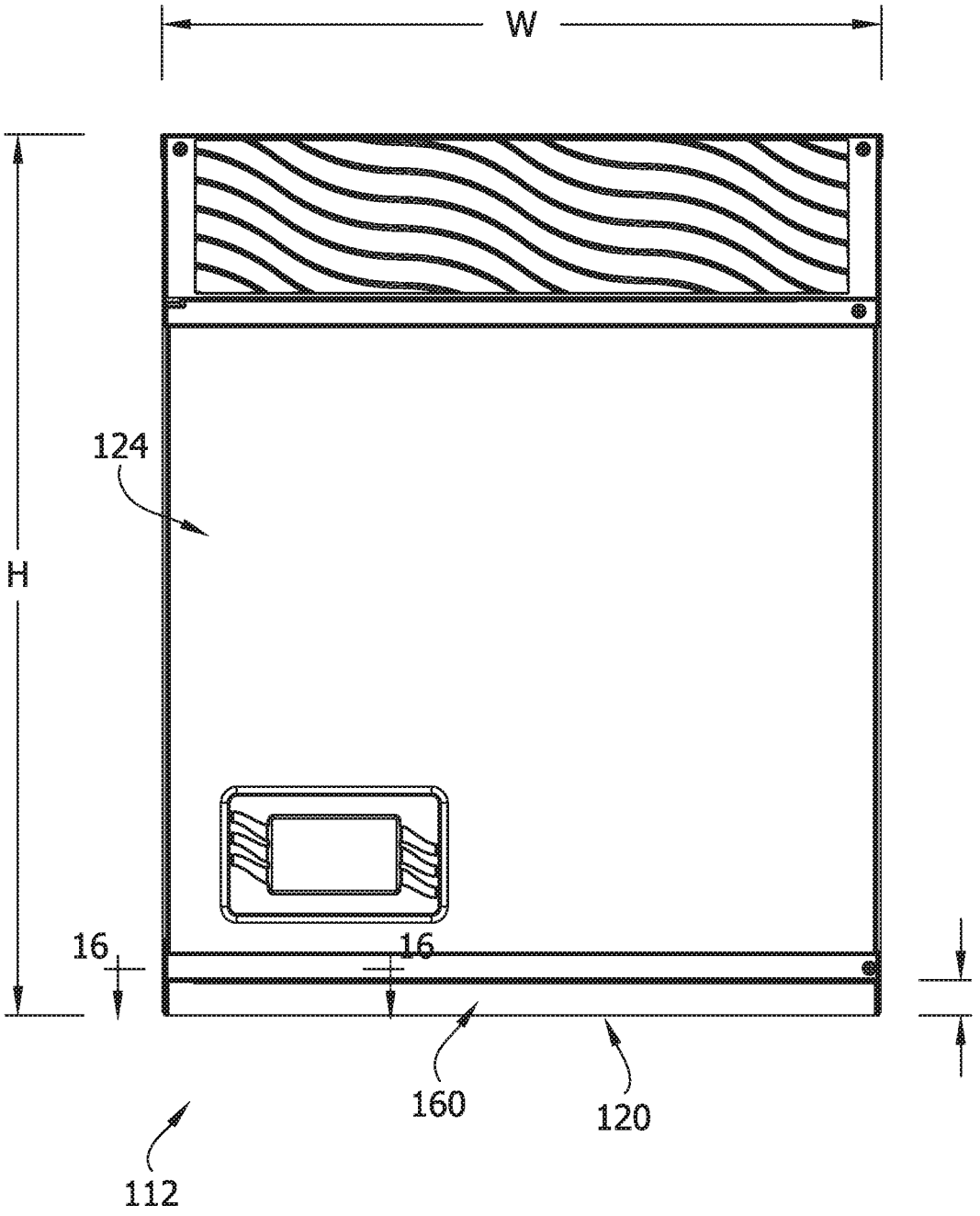
FIG. 6 is a front elevation of the ice maker of FIG. 3 with the door in the closed position.
Figure 7:
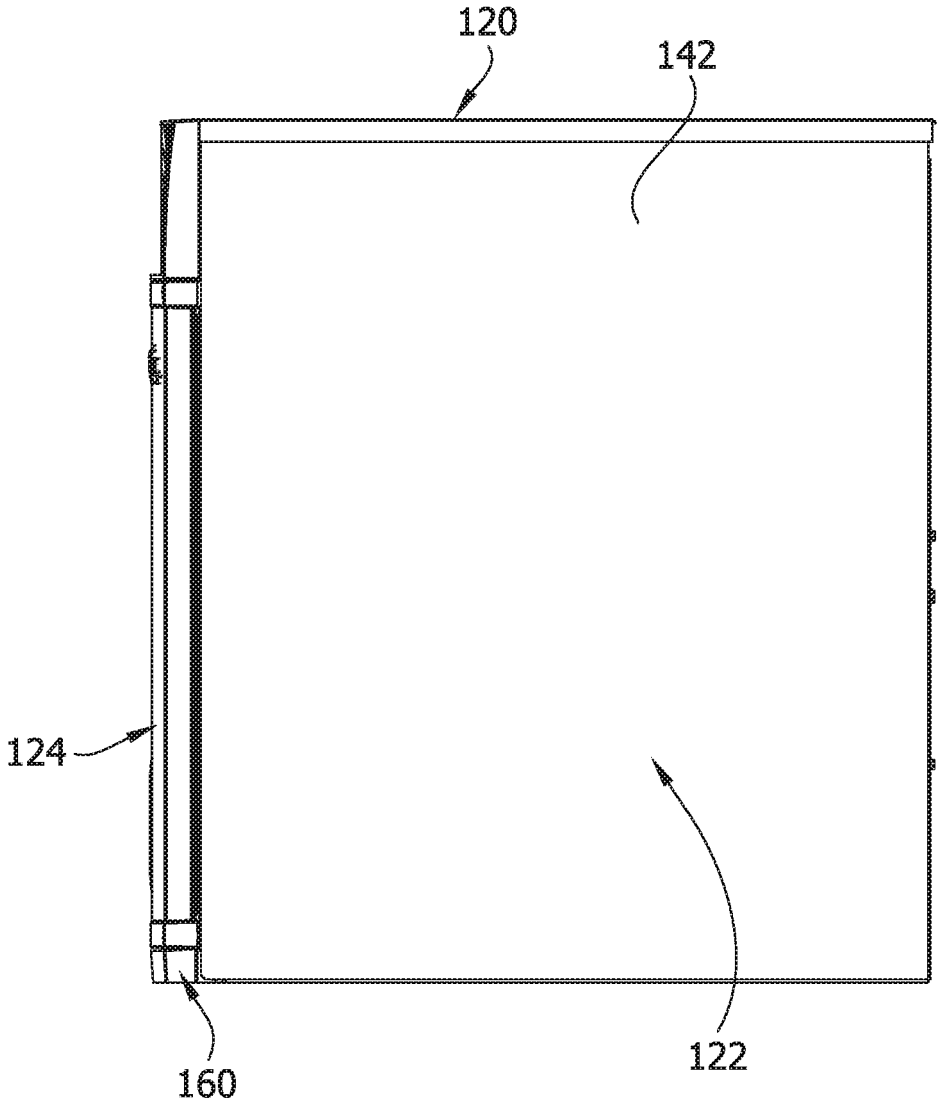
FIG. 7 is a side elevation of the ice maker of FIG. 3 with the door in the closed position.

Referring to FIG. 6, the prefabricated door 124 is connected to the prefabricated cabinet 122 such that the bottom of the door is spaced apart above the bottom of the prefabricated housing 120 by a distance D. In one or more embodiments, the distance D is at least about 10 mm, e.g., at least about 15 mm, at least about 20 mm, at least about 25 mm. The distance D is greater than the distance by which the dispensing unit enclosure 34 protrudes above the ice receptacle 30 in one or more embodiments. As such, the door 124 can clear the dispensing unit enclosure 34 as it moves between the open and closed positions while the ice maker 112 is mounted on the ice dispenser 14.

Figure 13:
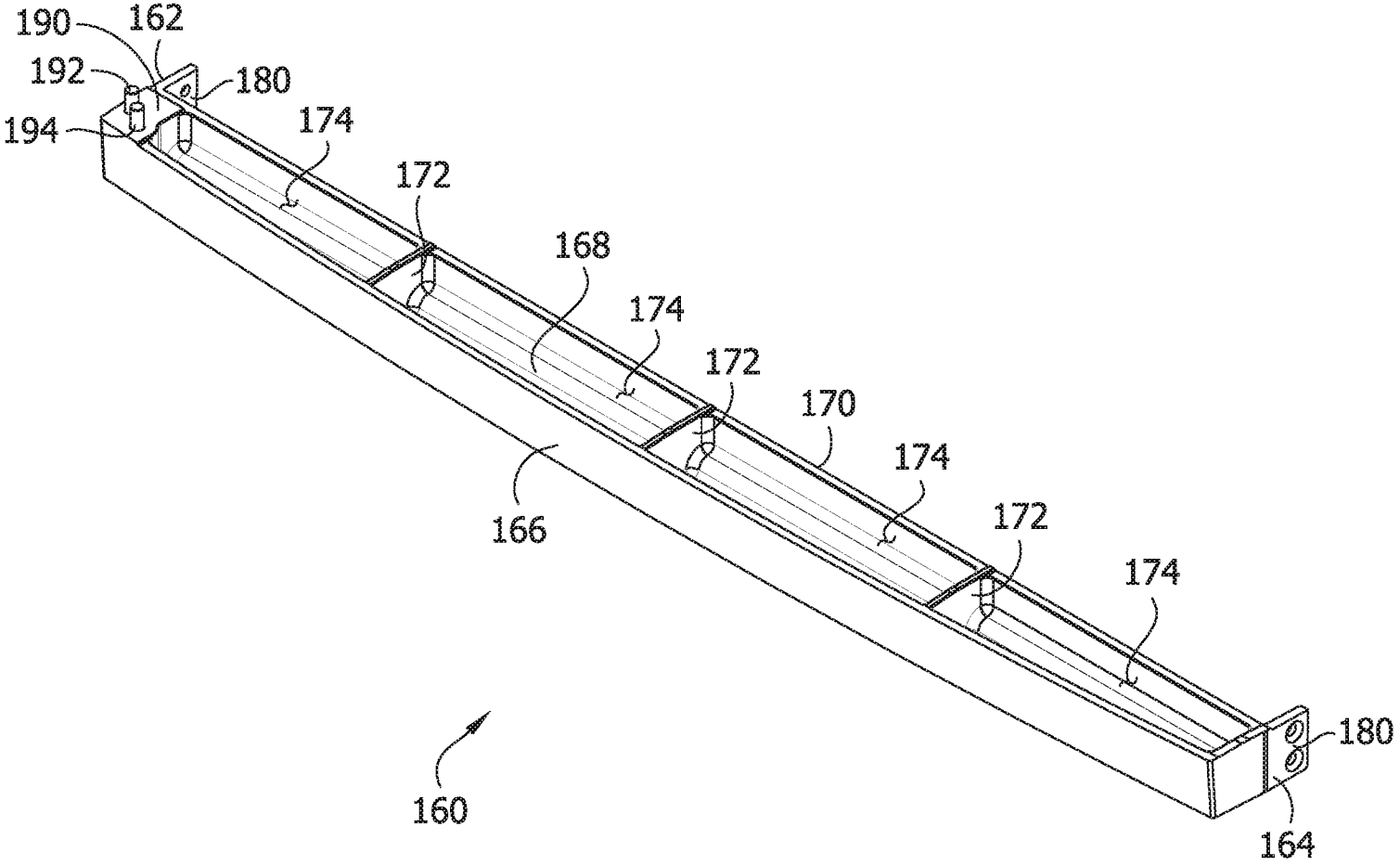
FIG. 13 is a perspective of the sill.

The housing 120 further comprises a sill 160 adjacent the bottom end of the doorway 134. The sill 160 is connected to the cabinet 122 such that the door 124 is located directly above the sill when the door is closed. The sill substantially fills the vertical space between the bottom of the door 124 and the bottom of the housing 120. Referring to FIG. 13, the sill 160 comprises a left end wall 162 (broadly, a first end portion) and a right end wall 164 (broadly, a second end portion) spaced apart along the width W of the prefabricated housing 120. A front wall 166, a bottom wall 168, and a rear wall 170 extend widthwise from the left end wall to the right end wall. The bottom wall 168 defines a bottom of the sill 160 which is substantially vertically aligned with the bottom of the prefabricated housing 120. The end walls 162, 164, the font wall 166, and the rear wall 170 generally form an exterior perimeter of the sill 160. A plurality of interior walls 172 extend from the front wall 166 to the rear wall 170 at spaced apart locations along the width W and subdivide an interior space within the exterior perimeter of the sill 160. The interior of the sill 160 thus includes a plurality of recesses 174 above the bottom wall 168. Each recess 174 extends front-to-back between the front wall 166 and rear wall 170 and extends widthwise between respective ones of the end walls 162, 164 and the interior walls 172. In one or more embodiments, the recesses 174 are configured to catch condensation which forms on the interior surface of the closed door 124 and flows off of the bottom of the door.

Figure 11A:
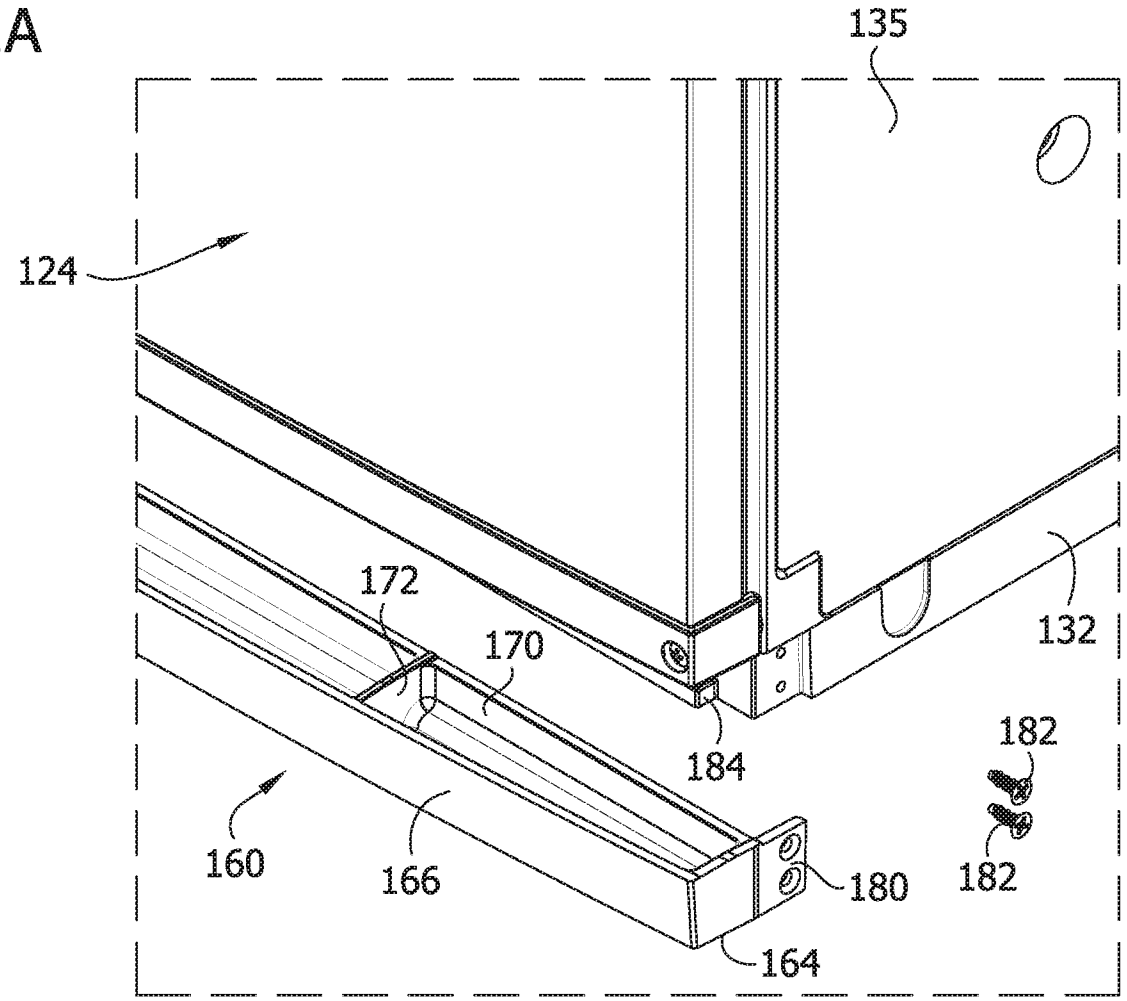
FIG. 11A is an enlarged exploded perspective of a portion of the subassembly of FIG. 10.
Figure 19:
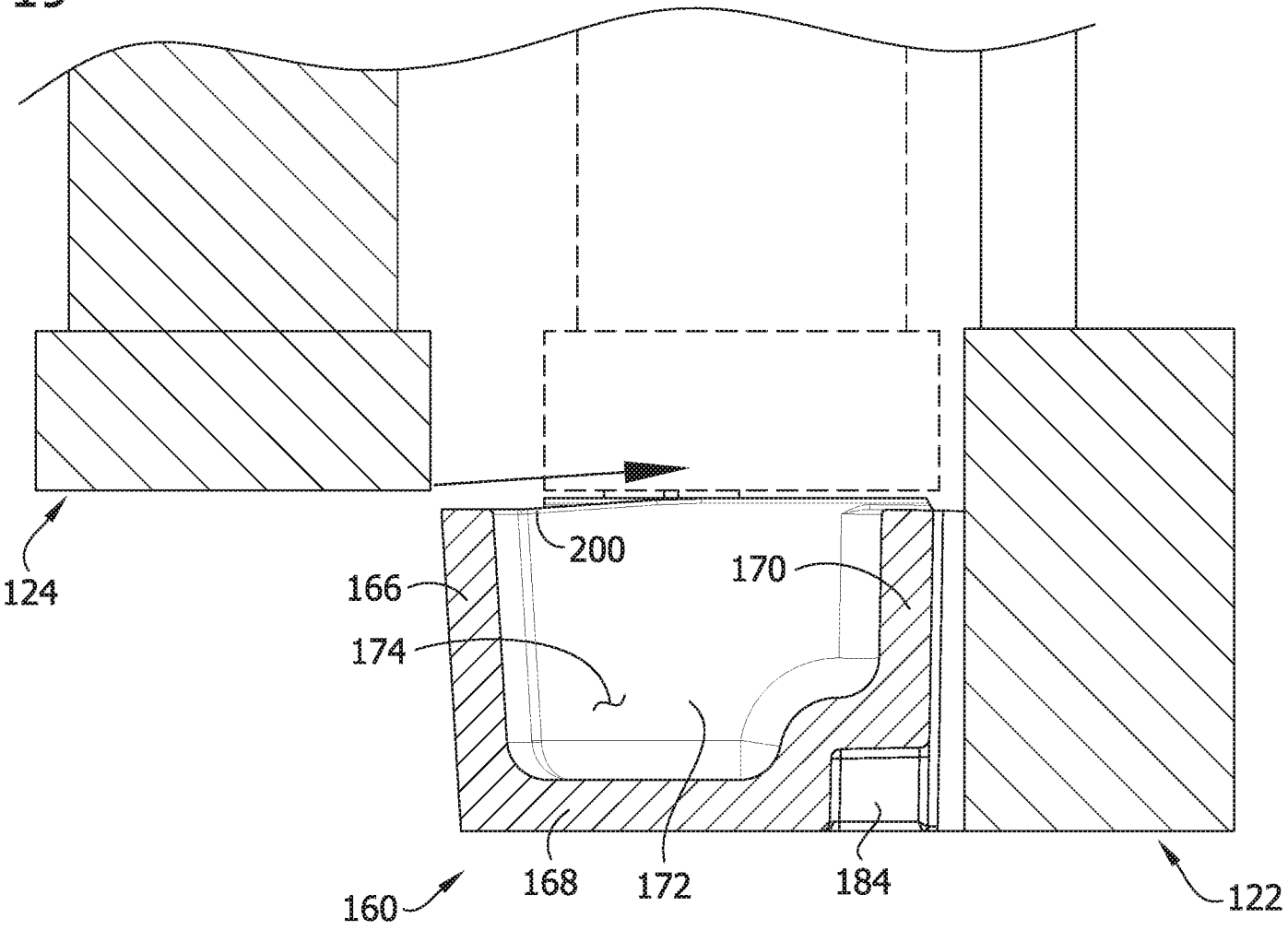
FIG. 19 is a cross section similar to FIG. 15 schematically illustrating the door as it moves along the sill toward the closed position.

Referring to FIGS. 11A and 13, each of the left and right walls 162,164 has a bracket portion 18*o* that projects rearward of the rear wall 170. The bracket portions 18*o* are generally configured to attach the sill 160 to the cabinet 122. In the illustrated embodiment, the sill 160 is configured to mount directly on the base 132 of the cabinet 122, but the sill could mount on the cabinet in other ways in other embodiments. For example, it is expressly contemplated that the sill could be an integral front portion of the base in one or more embodiments. However, in the illustrated embodiment, the sill 160 is configured to removably attach to the base 132. Specifically, screws 182 (broadly, removable fasteners) attach the bracket portions 180 to front corner portions of the base 132. As shown in FIGS. 8 and 9, the side panels 142 cover the screw connections between the base 132 and the sill 160. Suitably, the side panels 142 are removable (see FIG. 10) to reveal the screws 182 such that the sill 160 can be selectively removed when needed. Referring to FIGS. 11A and 19, the front end of the base 132 includes one or more protruding toes 184 that are configured to underlie a portion of the sill 160 to provide vertical support to the sill between the two bracket portions 180. In the illustrated embodiment, the rear wall 170 of the sill 160 includes a recess that is configured to receive the toe 184 when the sill is mounted on the base 132. Thus, the rear wall 170 rests on the toe 184 and the toe vertically supports the sill 160.

Figure 14:
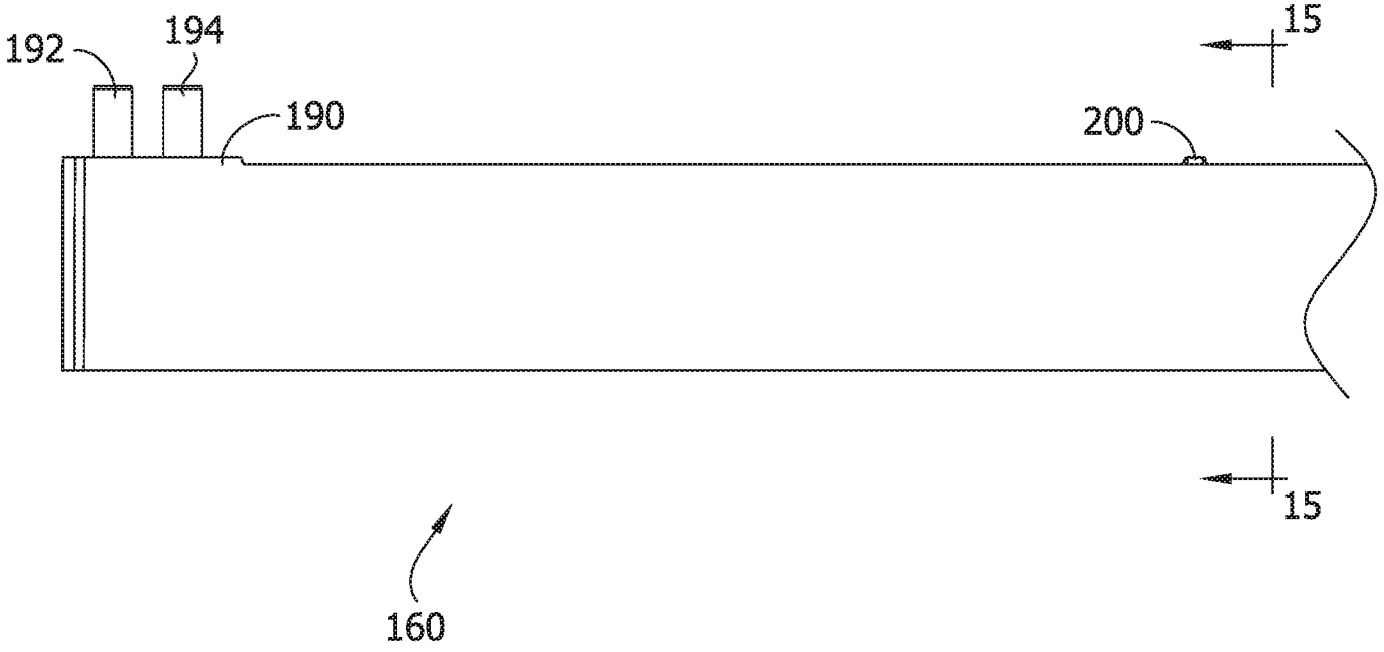
FIG. 14 is an enlarged fragmentary front elevation showing of an end portion of the sill.
Figure 15:
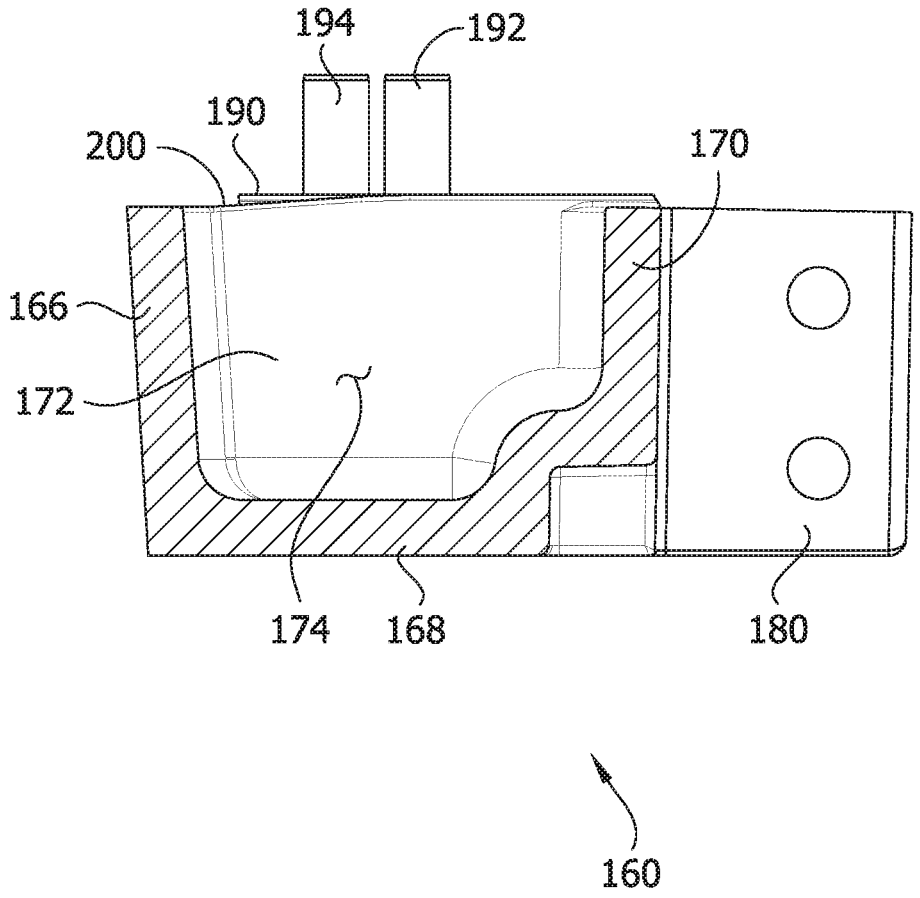
FIG. 15 is a cross section of the sill taken in the plane of line 15-15 of FIG. 14.

The sill 160 has a top portion that is partially defined by the end walls, 162, 164, the front wall 166, the rear wall 168, and the interior walls 172. The top portion of the sill 160 includes a raised support 190 at the left end portion of the sill (broadly, the first end portion or hinge end portion of the sill). As shown in FIG. 14, the raised support 190 has a top end that protrudes above the remainder of the top portion of the sill 160. In the illustrated embodiment, a hinge pin 192 is connected to the sill 160 such that the hinge pin extends upward from the raised support 190. In addition, a guide pin 194 is connected to the sill 160 such that the guide pin extends upward from the raised support 190 at a location spaced apart from the hinge pin 192. In an embodiment, one or both of the hinge pin 192 and the guide pin 194 is a discrete part that is separately attached to the sill 160; although either pin or both pins can also be integrally formed with the sill from a single piece of monolithic material in certain embodiments.

Figure 16:
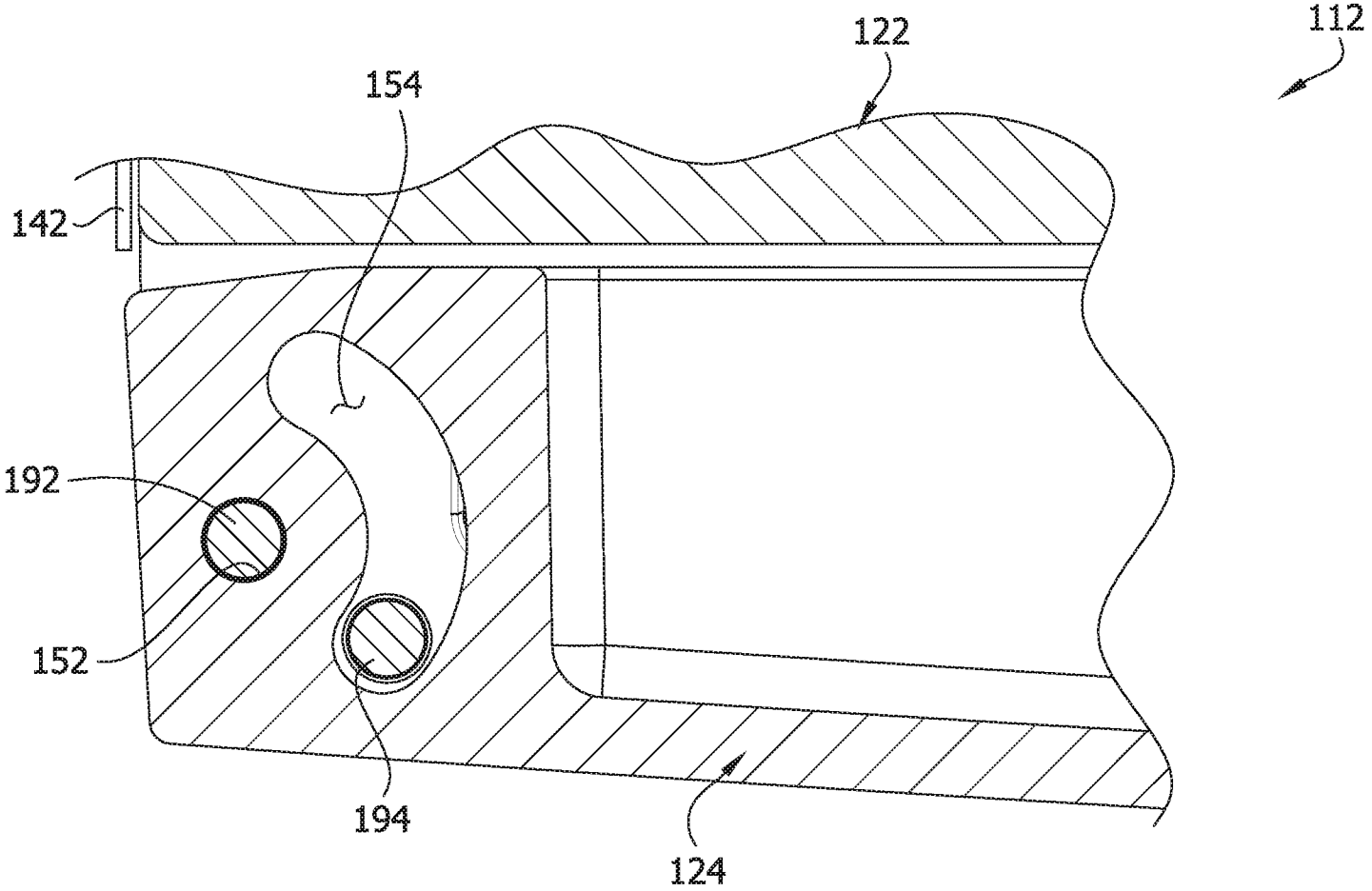
FIG. 16 is an enlarged fragmentary cross section of the ice maker of FIG. 3 taken in the plane of line 16-16 of FIG. 6 showing a hinged connection between the door and the sill.
Figure 17:
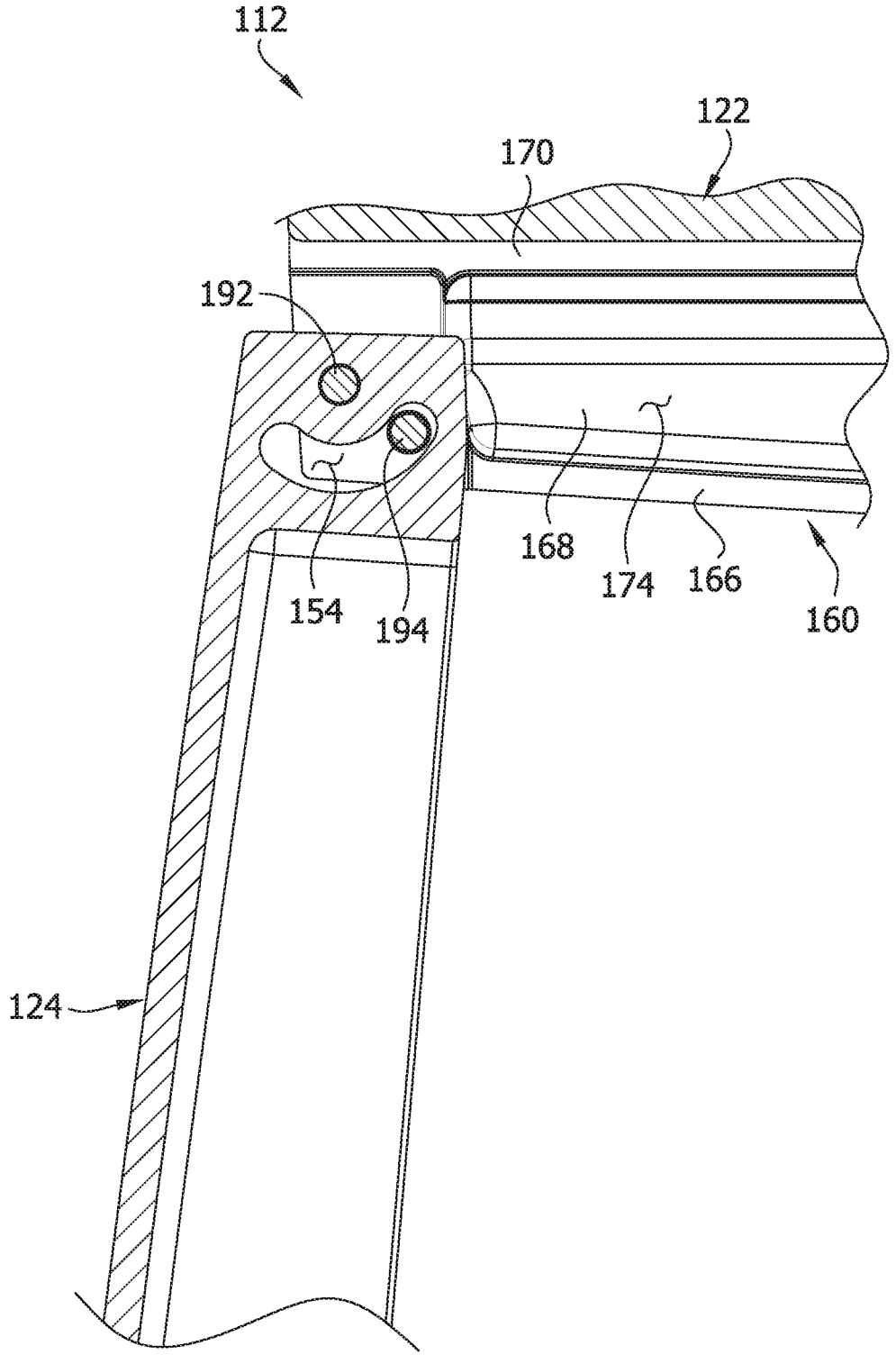
FIG. 17 is an enlarged fragmentary cross section similar to FIG. 16 but showing the door in an open position.
Figure 18:
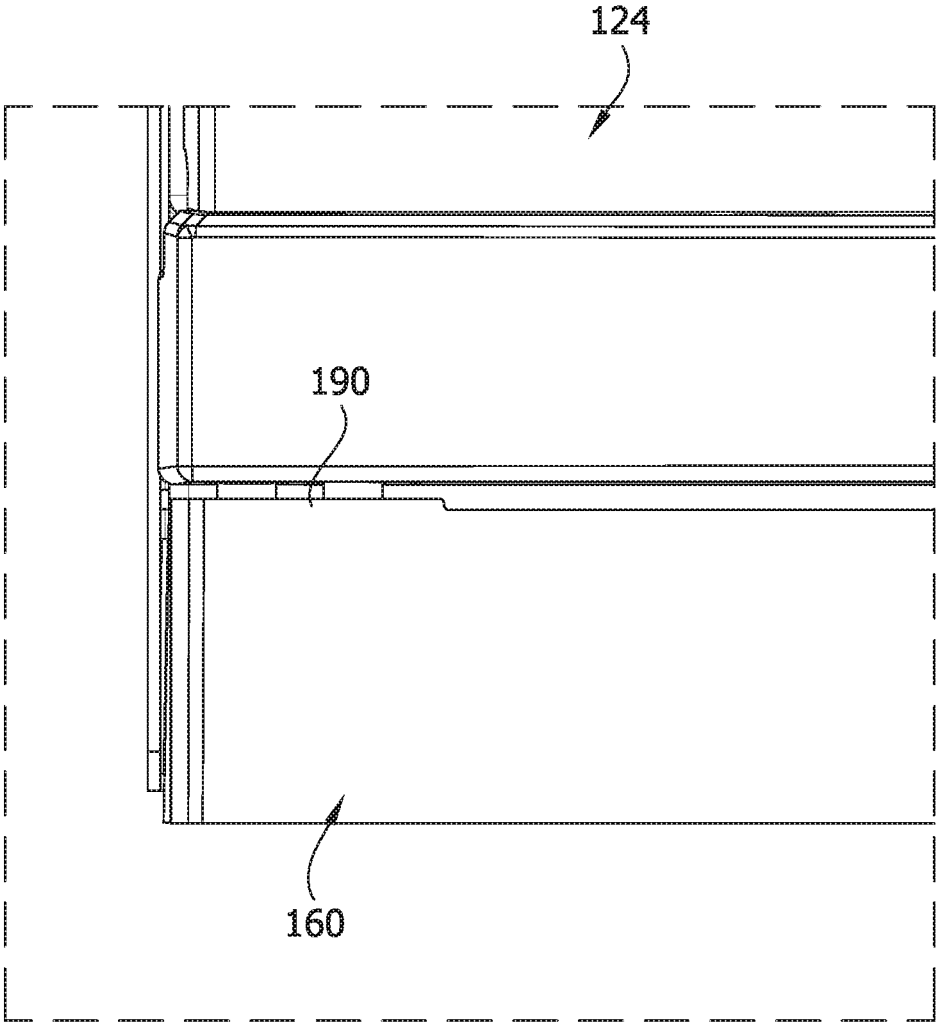
FIG. 18 is an enlarged view of a portion of FIG. 6.

Referring to FIGS. 16-18, the bottom end portion of the door 124 is configured to be pivotably coupled to the sill 160. More specifically, in the illustrated embodiment, the door 124 is configured to connect to the sill 160 at the raised support 190. The hinge pin 192 is rotatably received in the pin receiver 152 such that the door 124 rotates about the axis of the hinge pin on the cabinet 122. In the illustrated embodiment, the guide pin 194 is also slidably received in the elongate channel 154. The elongate channel receives the guide pin 194 (broadly, a protrusion) therein such that the door 124 tracks on the guide pin 194 within the elongate channel 154 as the door moves between the closed position (FIG. 16) and the open position (FIG. 17). As shown in FIG. 17, the guide pin 194 functions as a stop that stops movement of the door 124 away from the closed position in an opening direction. That is, as the door 124 moves in the opening direction the guide pin 194 will engage an end of the channel 154 to limit movement of the door in the opening direction. Thus in the illustrated embodiment, a door stop for limiting movement of the door in the opening direction is provided by the arcuate elongate channel 154 formed in the door and the protrusion (guide pin) 194 extending from the sill 160. However, other stop configurations can be used to limit movement of the door in the opening direction in other embodiments. For example, it is contemplated that, in one or more embodiments, the curved elongate channel is formed in the sill and the protrusion that is slidably received in the channel extends from the door.

As explained above, the hinge side of the prefabricated door 124 is connected to the sill 160 at the raised support 190. As shown in FIG. 18, connecting the door 124 to the sill 160 at the raised support 190 provides clearance between the bottom of the door and the remainder of the top portion of the sill. This limits interference between the door 124 and the sill 160 as the door moves to the closed position, even if the free side of the door opposite the hinge side sags (e.g., the door 124 is canted). Referring to FIG. 19, to further ensure the door 124 fully closes, the sill 160 includes at least one ramp 200, which slopes downward and outward away from the cabinet 122 in a direction transverse to the width of the sill. In the illustrated embodiment, the top end of each of the interior walls 172 defines a ramp 200. Each ramp 200 has a lower front end connected to the top end of the front wall 166 and an upper rear end spaced apart rearward of the front wall toward the rear wall 170. As shown in FIG. 19, if the door 124 sags on its hinges, the ramps 200 engage the bottom of the door as the door closes and as it begins to overlap the sill 160. The ramps 200 then guide the bottom of the door 124 upward until the door is positioned above the sill 160 in the fully closed position.

Referring to FIGS. 3 and 4, in an exemplary method of deploying or installing the ice maker 112, the prefabricated ice maker (or prefabricated ice maker kit) is received at a deployment site remote from the production or assembly site for the prefabricated unit. In an embodiment, the prefabricated ice maker 112 (or prefabricated ice maker kit) is removed from packaging at the deployment site. If necessary, after removing the ice maker 112 from the packaging, the prefabricated door 124 is mounted on the prefabricated cabinet 122 (e.g., by connecting the door mount integrated into the cabinet to the connector integrated into the door) to form the housing 120. The prefabricated cabinet 122 is mounted directly on a prefabricated receptacle 30 of the ice dispenser 14, without positioning any other structure between the prefabricated cabinet and the prefabricated ice receptacle. Mounting the prefabricated cabinet 122 directly on the receptacle 30 positions the housing 120 such that the bottom of the housing is substantially flush with the top of the receptacle. Moreover, because the prefabricated cabinet 122 mounts the prefabricated door 124 so that it is spaced apart above the bottom of the housing 120, mounting the prefabricated cabinet directly on the receptacle positions the door so that the bottom of the door is spaced apart above the top end portion of the dispensing unit enclosure 34. Once the housing 120 is assembled (if required) and mounted on the dispenser 14, the door 124 can swing freely on the hinges between the open and closed positions without interfering with the dispenser. Thus, a technician can readily open the door 124 to access the ice making device 130 for maintenance or repair. Furthermore, upon deployment, the sill 160 functions to guide the door 124 to the fully-closed position, even if the door begins to sag on its hinges. And once the door is closed, the sill 160 can catch condensation associated with use of the ice maker 112 that runs off of the door 124

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

In view of the above, it will be seen that the several objects of the invention are achieved and other advantageous results attained.

As various changes could be made in the above products and methods without departing from the scope of the invention, it is intended that all matter contained in the above description shall be interpreted as illustrative and not in a limiting sense.

What is claimed is:

1. An ice maker for making ice, the ice maker comprising:
an ice making device configured to form ice pieces;
a housing is configured to be mounted on an ice receptacle, wherein the ice making device is received in the housing, the housing comprising:
a prefabricated cabinet including a base that defines a bottom of the housing, the base defining at least one opening through which the ice pieces formed by the ice making device are passable into the ice receptacle when the prefabricated housing is mounted on the ice receptacle, the cabinet having an access side extending up from the base and defining a doorway for accessing the ice making device; and
a prefabricated door connected to the prefabricated cabinet for movement relative to the prefabricated cabinet between an open position and a closed position, the prefabricated door closing the doorway in the closed position and opening the doorway in the open position, the prefabricated door having a height and a bottom and a top spaced apart along the height, the bottom of the prefabricated door being spaced apart above the bottom of the housing in the closed position.

2. An ice maker as set forth in claim 1, wherein the bottom of the prefabricated door is spaced apart above the bottom of the housing by at least 10 mm in the closed position.

3. An ice maker as set forth in claim 1, wherein the doorway has a bottom end, the bottom end of the doorway being spaced apart above the bottom of the housing.

4. An ice maker as set forth in claim 3, wherein the bottom end of the doorway is spaced apart above the bottom of the housing by at least 25 mm.

5. An ice maker as set forth in claim 1, wherein the prefabricated cabinet comprises an enclosed side adjacent to the access side, the enclosed side comprising a one-piece side panel extending from a top end portion spaced apart above a top of the ice making device to a bottom end portion at the bottom of the housing.

6. An ice dispensing assembly comprising the ice maker of claim 1 and an ice dispenser including a prefabricated ice receptacle having a top, the ice maker mounted on the ice dispenser such that the bottom of the housing is substantially flush with the top of the prefabricated ice receptacle.

7. An ice maker as set forth in claim 1, wherein the prefabricated cabinet includes an ice making device support having a bottom wall forming the base and a vertical support wall extending upward from the bottom wall, the ice making device being mounted on the vertical support wall, the vertical support wall and the bottom wall being integrally formed from a single monolithic piece of material.

8. An ice maker as set forth in claim 1, wherein the doorway has a bottom end and the housing comprises a sill adjacent to the bottom end of the doorway, the prefabricated door being located directly above the sill in the closed position.

9. An ice maker as set forth in claim 8, wherein the sill is removably attached to the prefabricated cabinet.

10. An ice maker as set forth in claim 8, wherein the housing comprises a hinge pin connected to the sill, the prefabricated door being connected to the hinge pin for rotation about an axis of the hinge pin between the open and closed positions.

11. An ice maker as set forth in claim 10, wherein one of the prefabricated door and the sill comprises a protrusion and the other of the prefabricated door and the sill comprises an elongate channel extending lengthwise along an arcuate path generally centered about the hinge pin, the elongate channel receiving the protrusion therein such that the protrusion moves along the arcuate channel as the prefabricated door moves from the closed position toward the open position in an opening direction, the elongate channel having an end that engages the protrusion as the prefabricated door moves in the opening direction to limit movement of the prefabricated door in the opening direction.

12. An ice maker as set forth in claim 8, wherein the sill comprises a stop configured to engage the prefabricated door as the prefabricated door moves in an opening direction from the closed position toward the open position to limit movement of the prefabricated door in the opening direction.

13. An ice maker as set forth in claim 8, wherein the prefabricated cabinet has a width;

the prefabricated door has a hinge side portion and a free side portion spaced apart along the width of the prefabricated cabinet in the closed position; and the sill has a first end portion adjacent to the hinge side portion of the prefabricated door, a second end portion spaced apart from the first end portion along the width of the prefabricated cabinet, and a sill width extending from the first end portion to the second end portion.

14. An ice maker as set forth in claim 13, wherein the sill has a top portion comprising a raised support at the first end portion of the sill, the raised support having a top end that protrudes above a remainder of the top portion of the sill.

15. An ice maker as set forth in claim 14, wherein the prefabricated door is hingedly connected to the raised support.

16. An ice maker as set forth in claim 13, wherein the sill comprises a top ramp sloping downward and outward way away from the prefabricated cabinet in a direction transverse to the sill width.

17. An ice maker as set forth in claim 13, wherein the sill comprises a front wall, a rear wall, and a bottom wall, each extending widthwise from the first end portion to the second end portion, the front wall, the rear wall, and the bottom wall defining at least one recess having an open top end.

18. An ice maker as set forth in claim 17, wherein the sill is configured to catch condensation flowing off of the prefabricated door in the at least one recess.

19. An ice maker as set forth in claim 1, wherein the one-piece side panel is removable.

20. An ice maker as set forth in claim 19, wherein the doorway has a bottom end and the housing comprises a sill adjacent the bottom end of the doorway, the prefabricated door being located directly above the sill in the closed position.

21. An ice maker as set forth in claim 20, wherein the sill comprises an end wall having a projecting bracket portion configured to attach the sill to the prefabricated cabinet.

22. An ice maker as set forth in claim 21, wherein the one-piece side panel covers the bracket portion of the sill.

23. An ice maker as set forth in claim 20, wherein the one-piece side panel covers a portion of the sill.

24. An ice maker for making ice, the ice maker comprising:

an ice making device configured to form ice pieces;

a prefabricated cabinet configured to be mounted on the ice receptacle, wherein the ice making device is received in the prefabricated cabinet, the prefabricated cabinet including a base that defines a bottom of the prefabricated cabinet, the base defining at least one opening through which the ice pieces formed by the ice making device are passable into the ice receptacle when the prefabricated cabinet is mounted on the ice receptacle, the prefabricated cabinet having a doorway for accessing the ice making device at least partially above the base, the prefabricated cabinet including a door mount adjacent to the doorway; and a prefabricated door including a connector configured to connect to the door mount to mount the prefabricated door on the prefabricated cabinet such that the prefabricated door is movable relative to the prefabricated cabinet between an open position and a closed position, the prefabricated door having a bottom that is spaced apart above the bottom of the prefabricated cabinet when the prefabricated door is mounted on the prefabricated cabinet by the connector connected to the door mount and the prefabricated door is positioned in the closed position.

* * * * *